US006205788B1

(12) United States Patent
Warren

(10) Patent No.: US 6,205,788 B1
(45) Date of Patent: Mar. 27, 2001

(54) MULTIPLE HEAT EXCHANGING CHAMBER ENGINE

(76) Inventor: Edward Lawrence Warren, 3912 Snowy Egret Dr., West Melbourne, FL (US) 32904

( * ) Notice: Subject to any disclaimer, the term of this patent is extended or adjusted under 35 U.S.C. 154(b) by 0 days.

(21) Appl. No.: 09/591,795

(22) Filed: Jun. 12, 2000

(51) Int. Cl.[7] ..... F02C 5/00; F01K 1/00
(52) U.S. Cl. ..... 60/643; 60/39.6
(58) Field of Search ..... 60/643, 39.6, 39.63, 60/39.62

(56) References Cited

U.S. PATENT DOCUMENTS

| | | | | |
|---|---|---|---|---|
| 635,095 | | 10/1899 | Fessler | 60/39.6 |
| 1,849,347 | * | 3/1932 | Dale | 60/39.6 |
| 2,151,759 | | 3/1939 | Hardensett | 60/39.62 |
| 4,696,158 | | 9/1987 | DeFrancisco | 60/39.62 |
| 5,109,666 | * | 5/1992 | Eickmann | 60/39.6 X |
| 5,551,233 | * | 9/1996 | Tomoiu | 60/39.6 X |
| 6,116,222 | * | 9/2000 | Warren | 123/543 |

* cited by examiner

*Primary Examiner*—Hoang Nguyen

(57) ABSTRACT

This invention is an external combustion engine that operates on an open or closed hot air cycle with isothermal compression of ambient temperature fluid; heat is added at constant volume; and the fluid is expanded to near ambient pressure. The engine has a compressor, heater, multiple heat exchanging chambers, and an expander. The heat, originating in a heater, is moved by fluid flow through a plurality of heat exchanging chambers in sequence, one heat exchanging chamber at a time. The heating circuit can be operated open or closed cycle. The more heat exchanging chambers, the more time for the heat exchanger in the heat exchanging chamber to heat up. Fluid from the heater circuit heats up a movable heat exchanger; valves isolate the heating circuit from the heat exchanging chamber; fluid is compressed through a compressor transfer valve into a heat exchanging chamber; the compressor transfer valve is closed; water is injected into the heat exchanging chamber; the heat exchanger gives up heat to and heats up the fluid and water in the heat exchanging chamber; the hot fluid and steam moves out of the heat exchanging chamber through an expander transfer valve into a conventional piston type expander which provides the output work.

11 Claims, 24 Drawing Sheets

MULTIPLE HEAT EXCHANGING CHAMBER ENGINE

BACKGROUND—FIELD OF INVENTION

Figure 1:
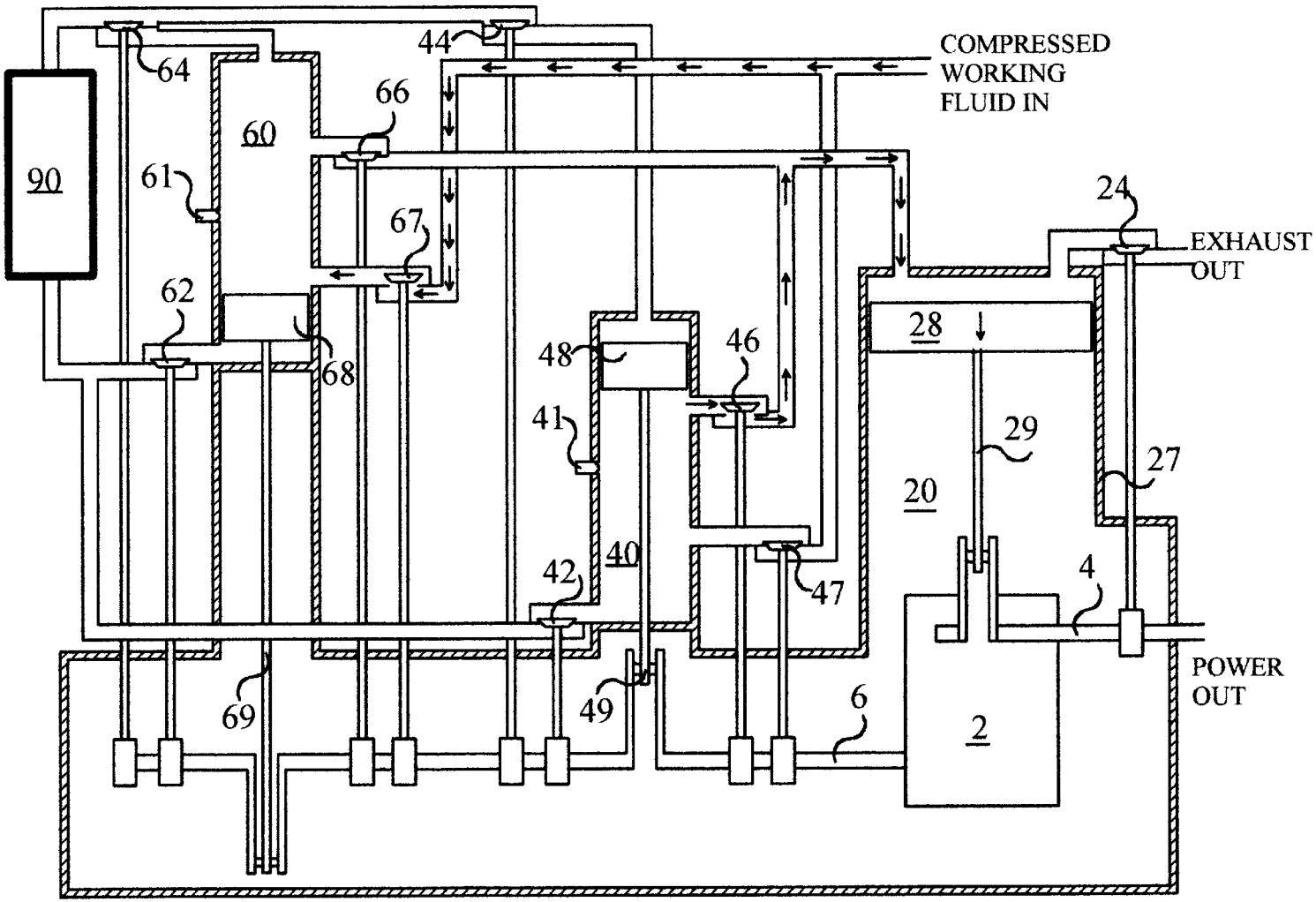

The present invention relates to, reciprocating, two stroke, external combustion engines with multiple heat exchanging chambers.

BACKGROUND—DESCRIPTION OF PRIOR ART

The present inventor has patent applications that relate to this invention. They are: "Two Stroke Regenerative Engine" Ser. No. 09/354670 dated Jul. 16, 1999, now U.S. Pat. No. 6,116,222. "Two Stroke Engine with Displacer" Ser. No. 09/383605 dated Aug. 26, 1999, now allowed and Multiple Chamber Engine dated Apr. 12, 1999.

Existing designs of external combustion engines require that the heat be transferred to the working fluid through the walls of the pressure vessel. This is true of steam engines, gas turbines, and the Stirling cycle engines. The gas turbines have some schemes where the heat can be transferred into the engine through rotating regenerators, but these have a high pressure on one side and require sealing. This Multiple Heat Exchanging Chamber Engine is an external combustion engine that does not require the heat to be transferred into the engine through pressurized walls, or by means of a regenerator requiring seals. In addition the engine can be water injected; the compressed working fluid can be cooled; the pressure ratio of the engine can be different from the expansion ratio of the engine; the engine can be operated on a closed or an open cycle; and the engine can have two or more heat exchanging chambers. The more heat exchanging chambers the engine has, the longer the heat exchange time; therefore, the engine can have very long heat exchanging time. This also results in more time for water injection to be effective.

SUMMARY

This invention is a two stroke, external combustion, reciprocating engine. The preferred embodiment of the invention is an engine comprised of a power output shaft, a gear box, a compressor, a storage tank, a heat source, and a number of similar working units made up of a plurality of heat exchanging chambers, and an expander.

The compressor is any compressor that can compress a fluid such as air. It can be a piston type, rotary, etc. and it can be an isothermal compressor.

There can be any number of heat exchanging chambers. Each of the heat exchanging chambers contains a movable heat exchanger, a heating fluid inlet valve, a heating fluid exit valve, an expander transfer valve, and a compressor transfer valve. The movable heat exchangers and the heat exchanging chamber valves are moved by a low speed shaft driven through a gearbox from the expander. The speed of the low speed shaft and hence the gear ratio of the gear box is determined by the number of heat exchanging chambers. The ratio of the speed of the low speed shaft to the speed of the power output shaft is one divided by the number of heat exchanging chambers; therefore in an engine with two heat exchanging chambers, the low speed shaft would travel at one half the speed of the power output shaft, and likewise an engine with nine heat exchanging chambers would have a low speed shaft traveling at one ninth the speed of the power output shaft.

The expander is a cylinder that is closed at one end and contains: an exhaust valve, a power piston that is connected to a power output shaft, and a gearbox to drive the low speed shaft, the heat exchanging chamber valves, and the movable heat exchangers.

The heat source is anything that can provide a hot heating fluid. It provides a hot heating fluid to the heating fluid inlet valves of all heat exchanging chambers. Means are provided to permit and control the flow of heating fluid into and out of the heat exchanging chambers. At the appropriate time, both the heating fluid inlet valve and the heating fluid exit valve of one of the heat exchanging chambers open and the heating fluid flows through the heat exchanging chamber, and the movable heat exchanger. At the same time the movable heat exchanger moves toward or into the heating fluid flow, and the heating fluid gives up heat to the movable heat exchanger. When the movable heat exchanger reaches the heating fluid inlet valve end of the heat exchanging chamber, both the heating fluid inlet valve and the heating fluid exit valve close, the compressor transfer valve opens, and the compressed working fluid from a commercial storage tank (not shown) goes into the heat exchanging chamber. The compressor transfer valve closes, water is injected, the movable heat exchanger then travels away from the heating fluid inlet valve end of the heat exchanging chamber and gives up heat to the working fluid, heating up the working fluid and increasing the pressure in the heat exchanging chamber. When the movable heat exchanger reaches the heating fluid exit valve end of the heat exchanging chamber, the expander transfer valve opens and the high pressure hot working fluid is applied to the expander's power piston moving it toward the power output shaft, and transferring power out through the power output shaft. When the expander reaches the limit of its travel an exhaust valve opens and the expander is exhausted. When the expander starts exhausting, the cycle repeats with the next heat exchanging chamber.

Additional embodiments of this invention provide for the compressor and the expander to be housed in the same cylinder, and driven by the same connecting rod.

OBJECTS AND ADVANTAGES

Several objects and advantages of the two stroke multiple heat exchanging chamber engine are:

a.) Heat is transferred into the engine without passing through any pressurized walls.

b.) The heat transfer time can be very long.

c.) The compressed working fluid can be cooled.

d.) The engine can be operated so that the charge is almost fully expanded.

e.) The heat for the engine can be supplied by solar, nuclear, garbage furnaces, or from waste heat from an industrial process.

f.) The engine can be water injected g.) The injected water can be provided a long time to heat and vaporize.

Other objects, advantages, and novel features will become apparent from the following detailed description of the Multiple Heat Exchanging Chamber Engine when considered in conjunction with the accompanying drawings.

DRAWING FIGURES

FIG. 1 depicts in detail the preferred embodiment of the Multiple Heat Exchanging Chamber Engine, with two heat exchanging chambers, at the start of an expansion cycle. Hot working fluid is coming from heat exchanging chamber 40 and compressed working fluid is going into heat exchanging chamber 60.

Figure 2:
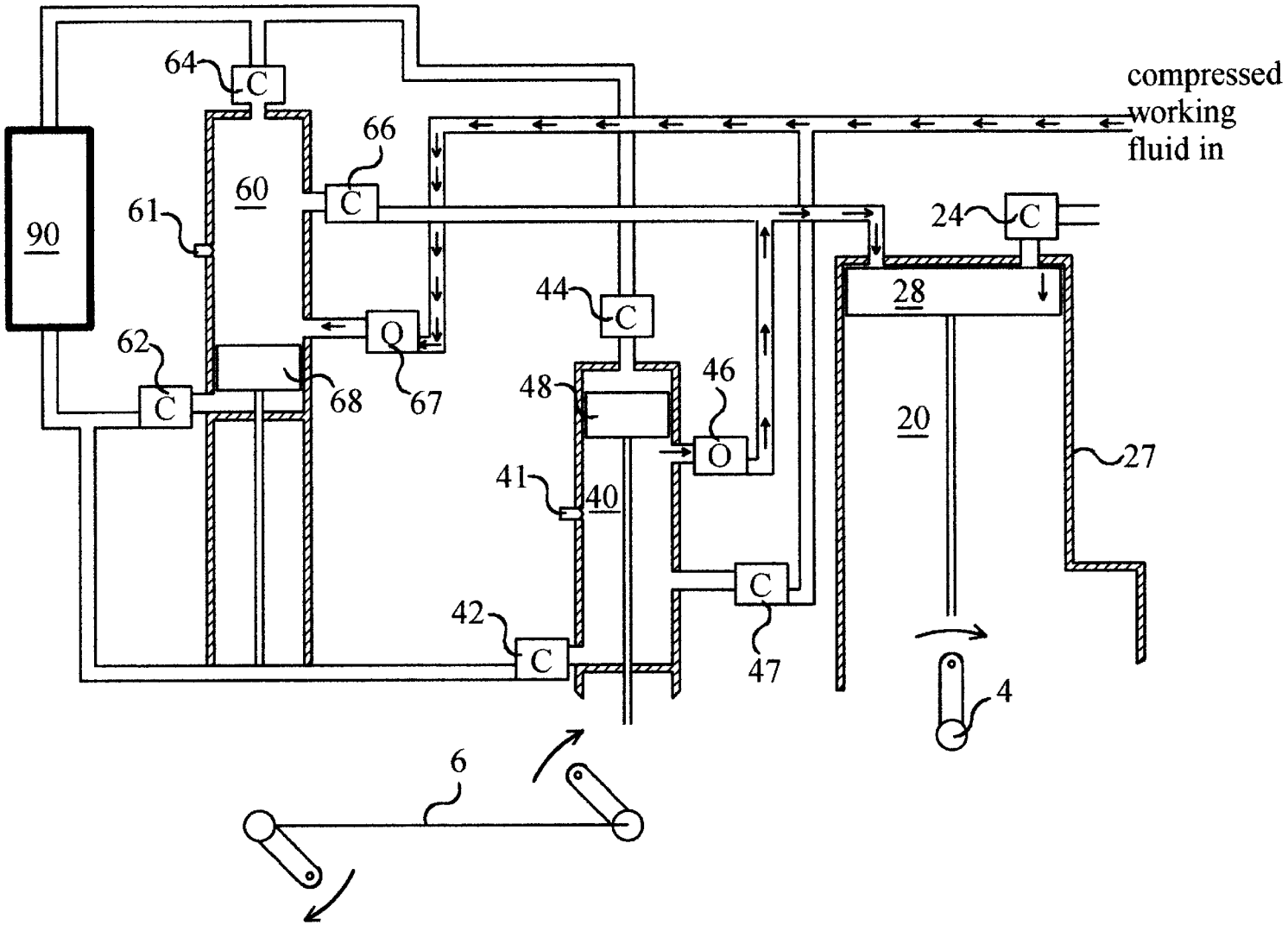

FIG. 2 shows a simplified version of the preferred embodiment of the Multiple Heat Exchanging Chamber Engine at the start of an expansion cycle with working fluid being compressed into heat exchanging chamber 60, and with hot working fluid coming from heat exchanging chamber 40 going into expander 20 and forcing down power piston 28.

Figure 3:
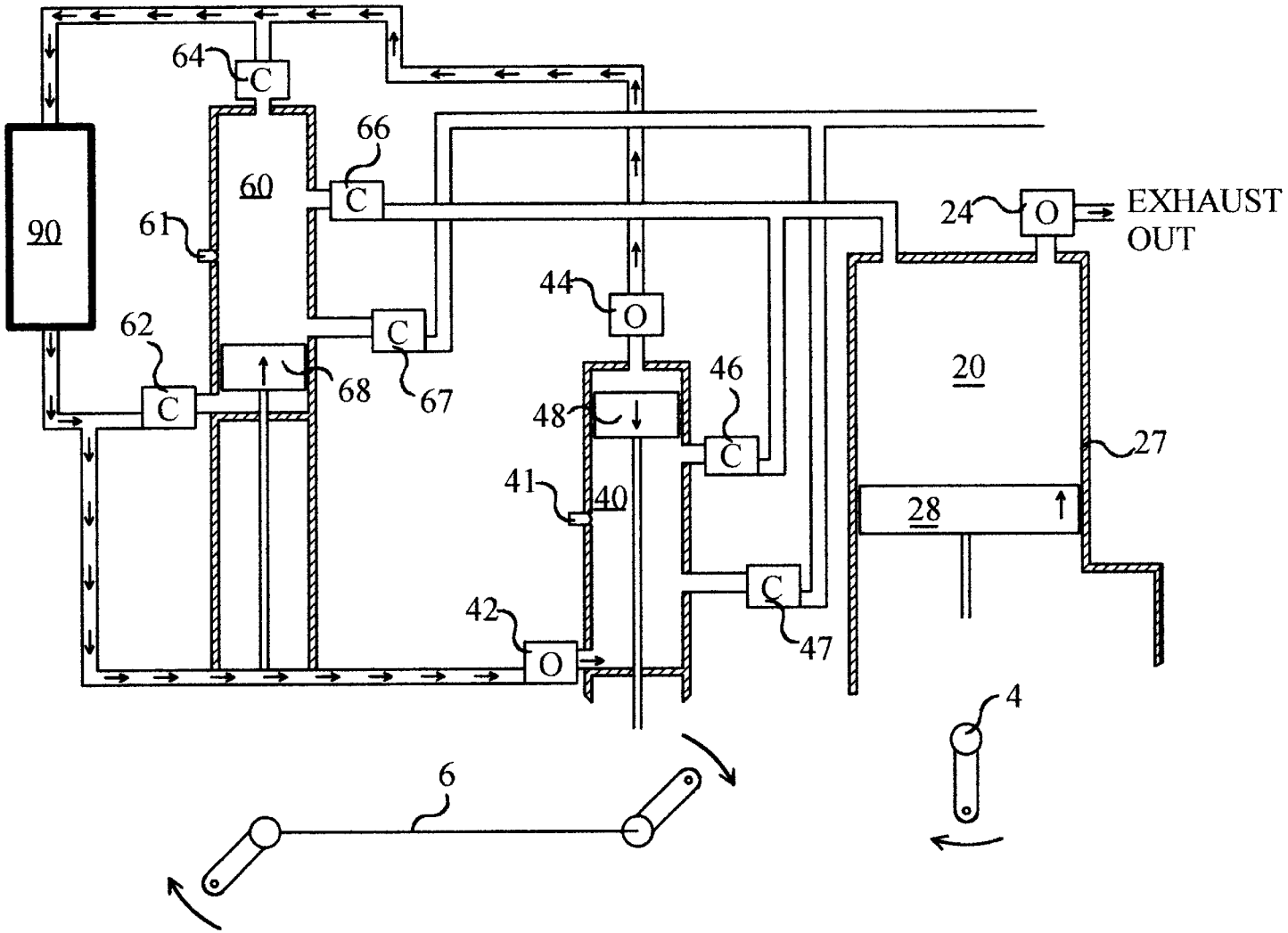

FIG. 3 shows a simplified version of the preferred embodiment of the Multiple Heat Exchanging Chamber Engine with hot heating fluid heating up movable heat exchanger 48 in heat exchanging chamber 40, with movable heat exchanger 68 heating up the compressed working fluid in heat exchanging chamber 60, and expander 20 exhausting.

Figure 4:
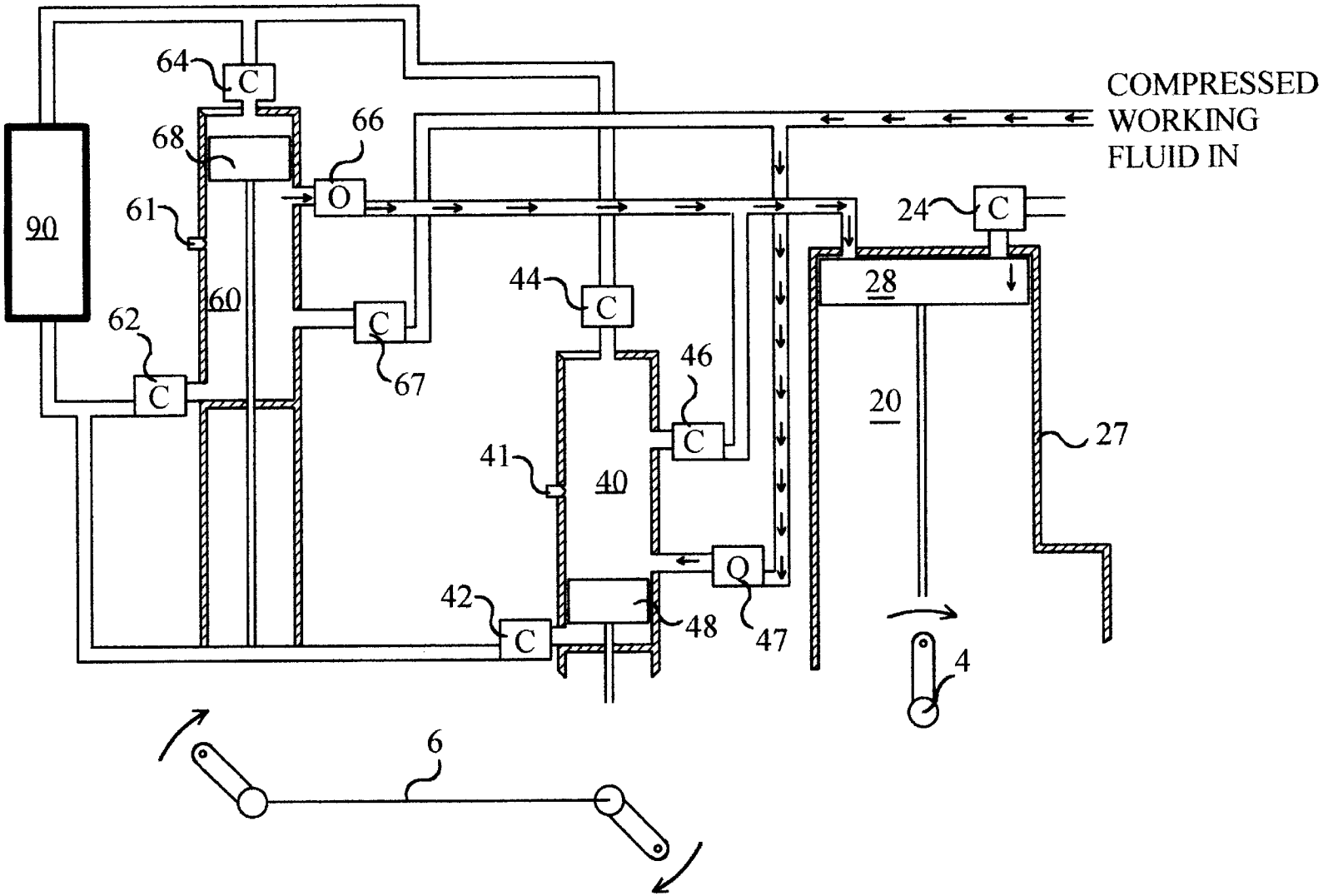

FIG. 4 shows a simplified version of the preferred embodiment of the Multiple Heat Exchanging Chamber Engine at the start of an expansion cycle with working fluid being compressed into heat exchanging chamber 40, and with hot working fluid coming from heat exchanging chamber 60 going into expander 20 and forcing down power piston 28.

Figure 5:
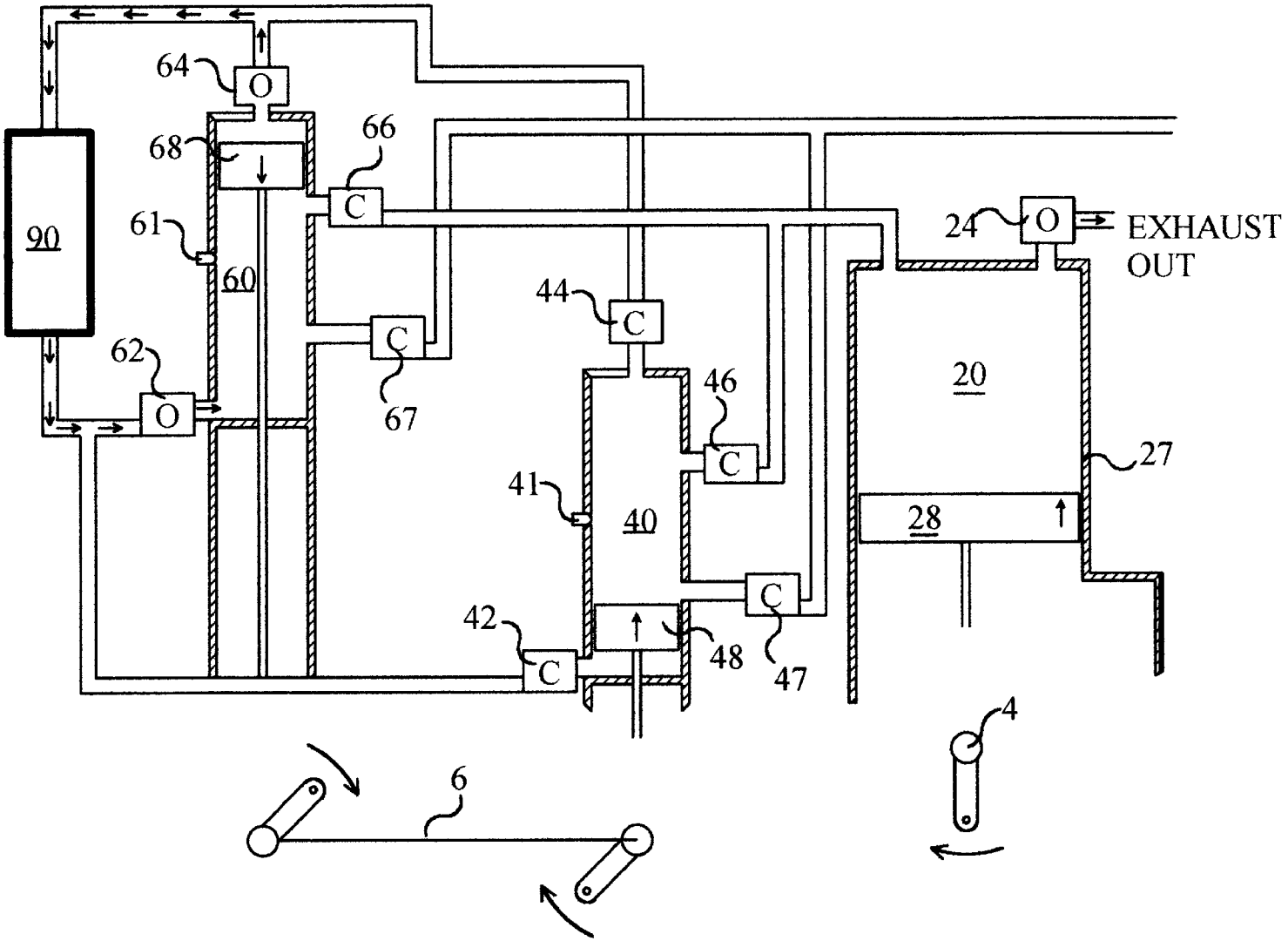

FIG. 5 shows a simplified version of the preferred embodiment of the Multiple Heat Exchanging Chamber Engine with hot heating fluid heating up movable heat exchanger 68 in heat exchanging chamber 60, with movable heat exchanger 48 heating up the compressed working fluid in heat exchanging chamber 40, and expander 20 exhausting.

Figure 6:
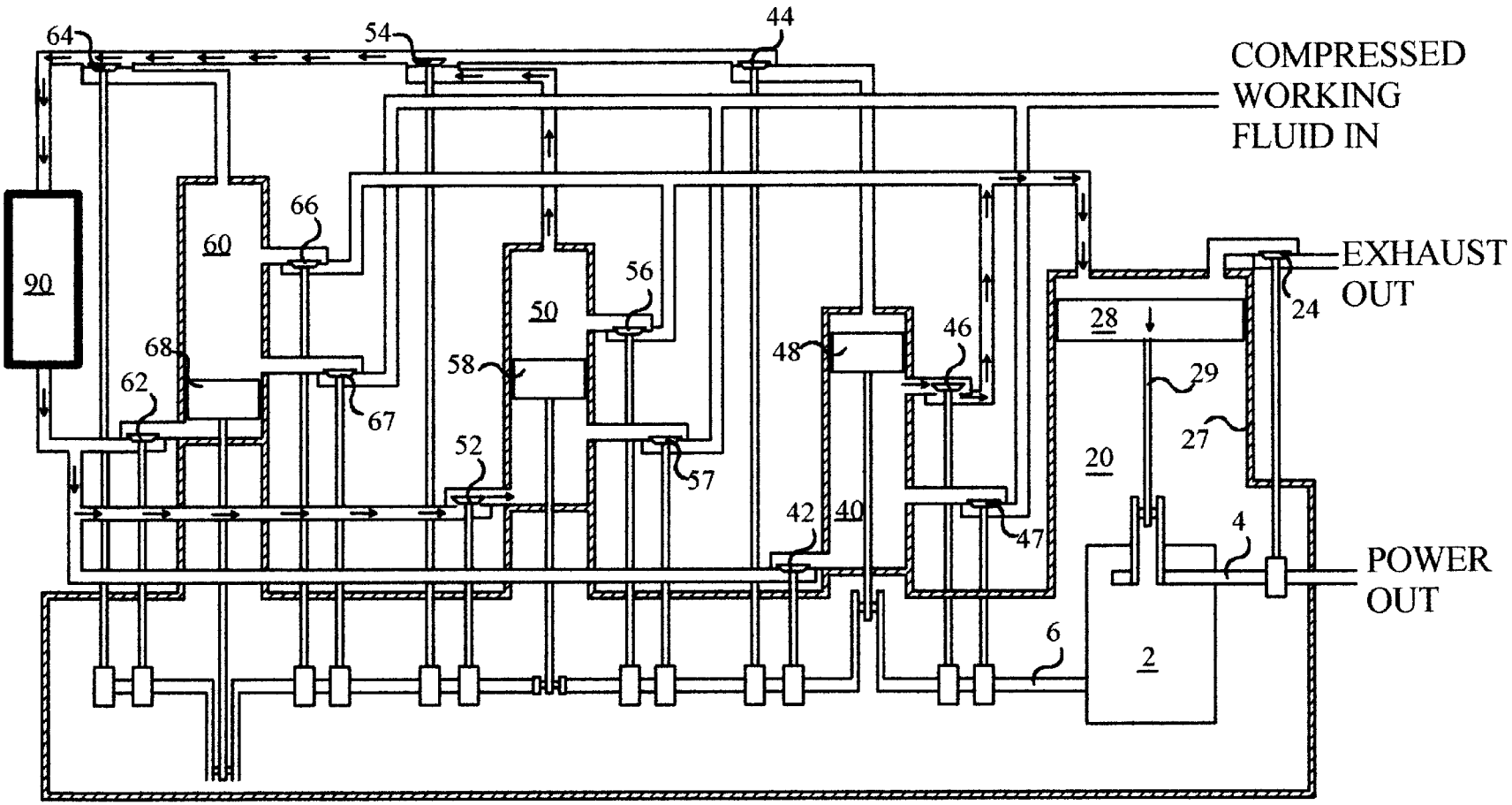

FIG. 6 depicts in detail the first alternate embodiment of the Multiple Heat Exchanging Chamber Engine at the start of an expansion cycle. It has three heat exchanging chambers instead of the two of the preferred embodiment. Hot working fluid is coming from heat exchanging chamber 40 to drive power piston 28, movable heat exchanger 58 is being heated by the heating fluid in heat exchanging chamber 50, and compressed working fluid is being heated in heat exchanging chamber 60.

Figure 7:
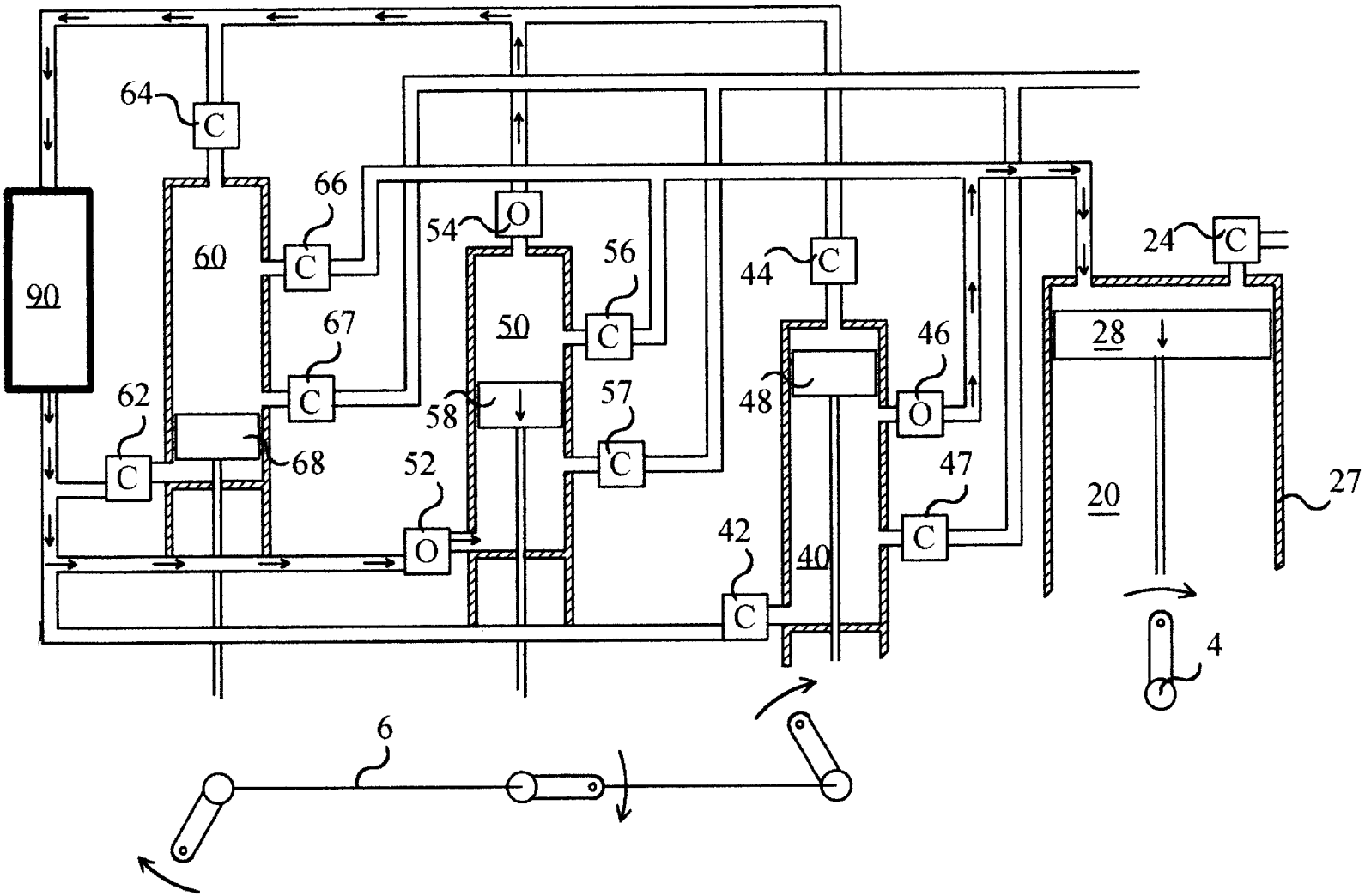

FIG. 7 shows a simplified version of the first alternate embodiment of the Multiple Heat Exchanging Chamber Engine at the start of an expansion cycle with hot working fluid coming from heat exchanging chamber 40 to drive power piston 28, movable heat exchanger 58 continues to be heated by the heating fluid in heat exchanging chamber 50, and compressed working fluid is being heated in heat exchanging chamber 60.

Figure 8:
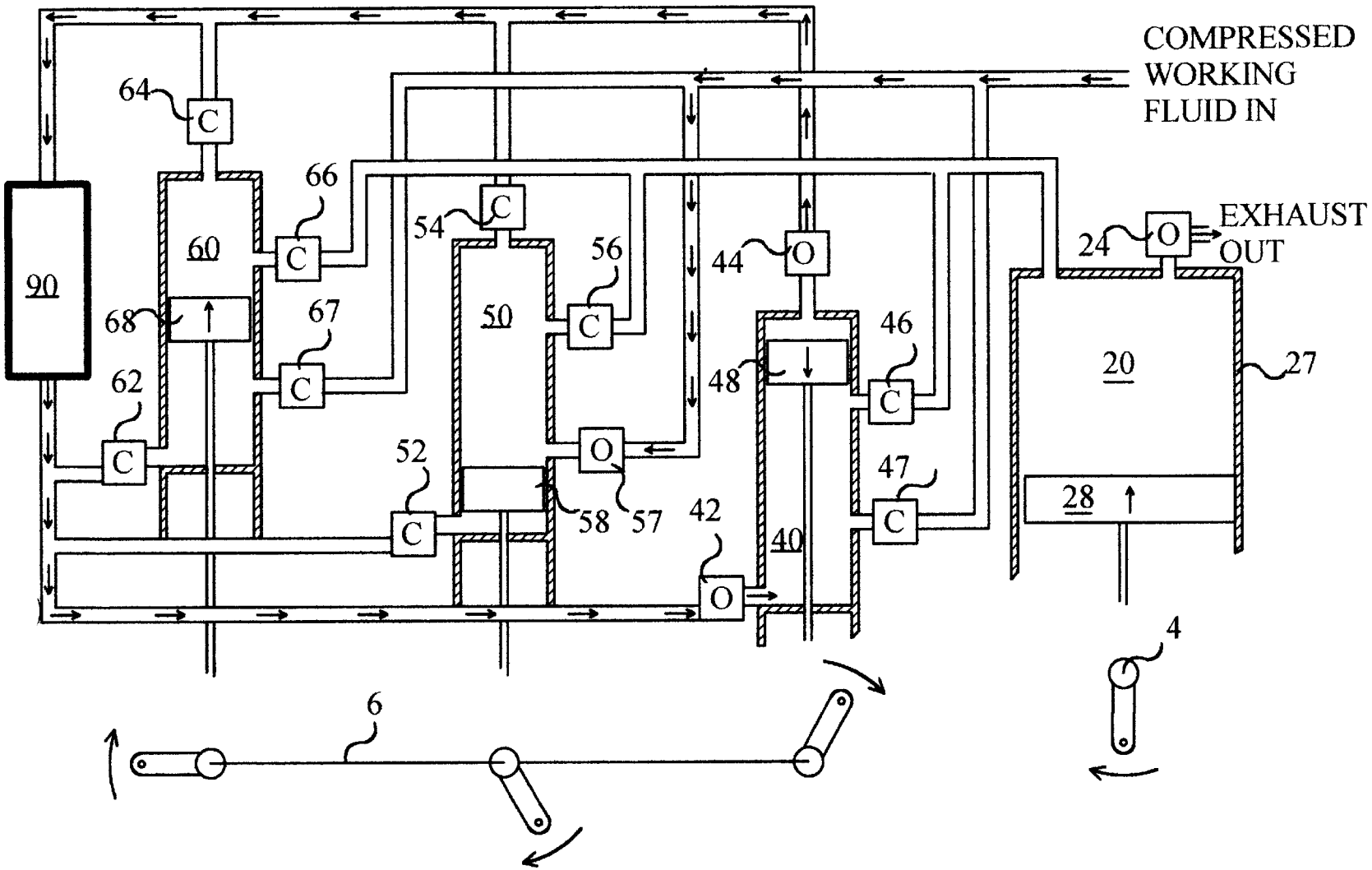

FIG. 8 shows a simplified version of the first alternate embodiment of the Multiple Heat Exchanging Chamber Engine at the start of an exhaust cycle with compressed working fluid going into heat exchanging chamber 50, movable heat exchanger 48 is being heated by the heating fluid in heat exchanging chamber 40, and compressed working fluid continues to be heated in heat exchanging chamber 60.

Figure 9:
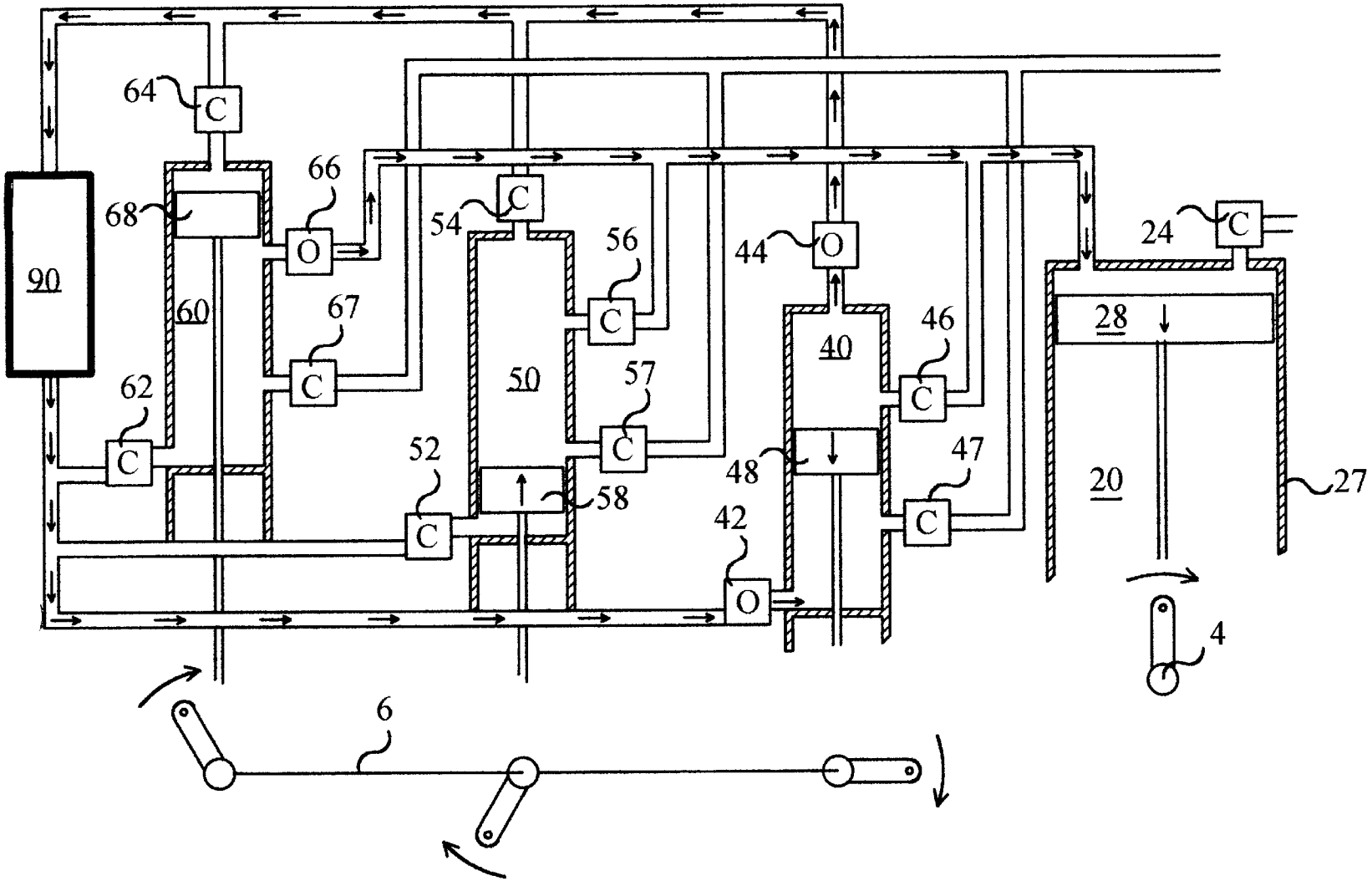

FIG. 9 shows a simplified version of the first alternate embodiment of the Multiple Heat Exchanging Chamber Engine at the start of an expansion cycle with hot working fluid coming from heat exchanging chamber 60 to drive power piston 28, movable heat exchanger 48 continues to be heated by the heating fluid in heat exchanging chamber 40, and compressed working fluid is being heated in heat exchanging chamber 50.

Figure 10:
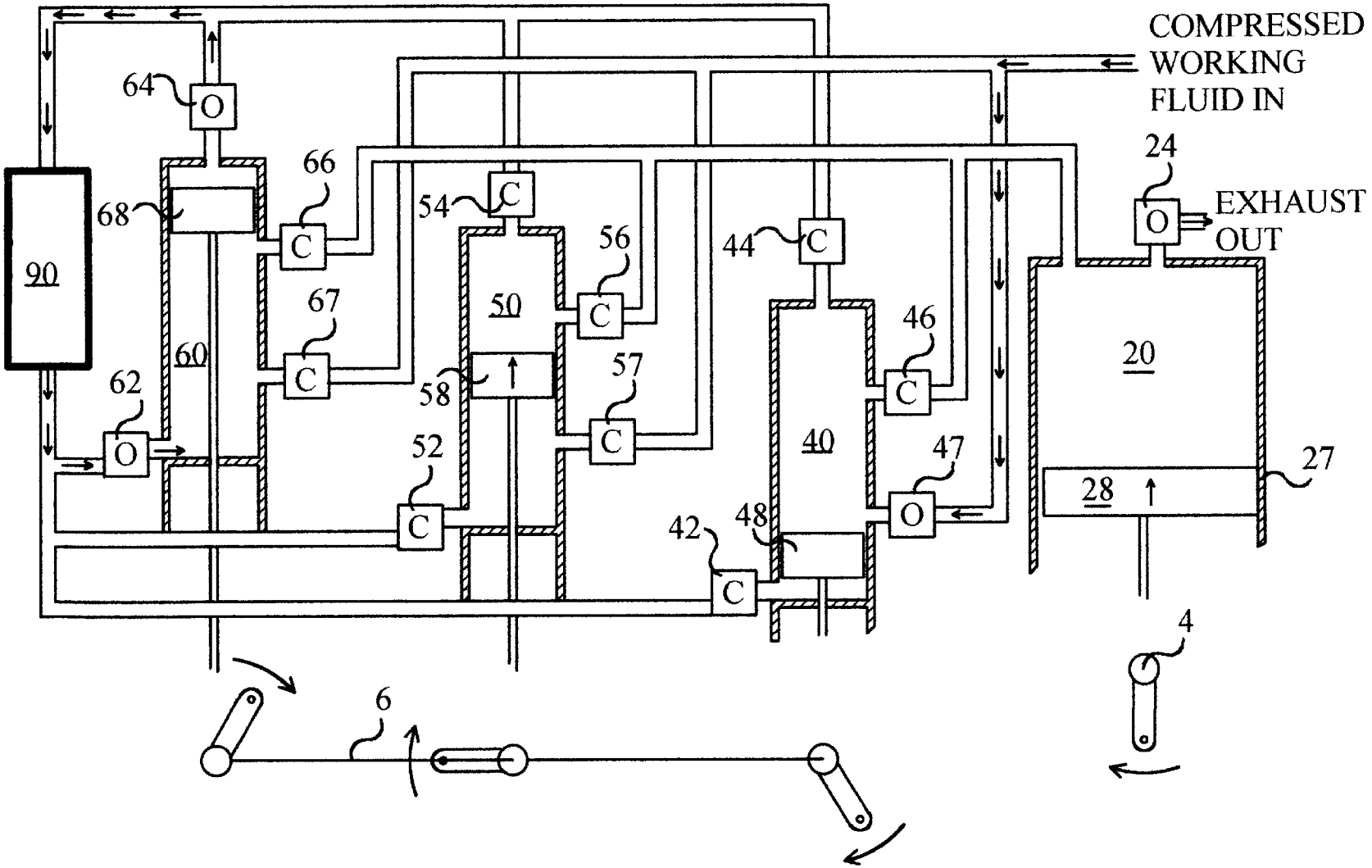

FIG. 10 shows a simplified version of the first alternate embodiment of the Multiple Heat Exchanging Chamber Engine at the start of an exhaust cycle with compressed working fluid going into heat exchanging chamber 40, movable heat exchanger 68 is being heated by the heating fluid in heat exchanging chamber 60, and compressed working fluid continues to be heated in heat exchanging chamber 50.

Figure 11:
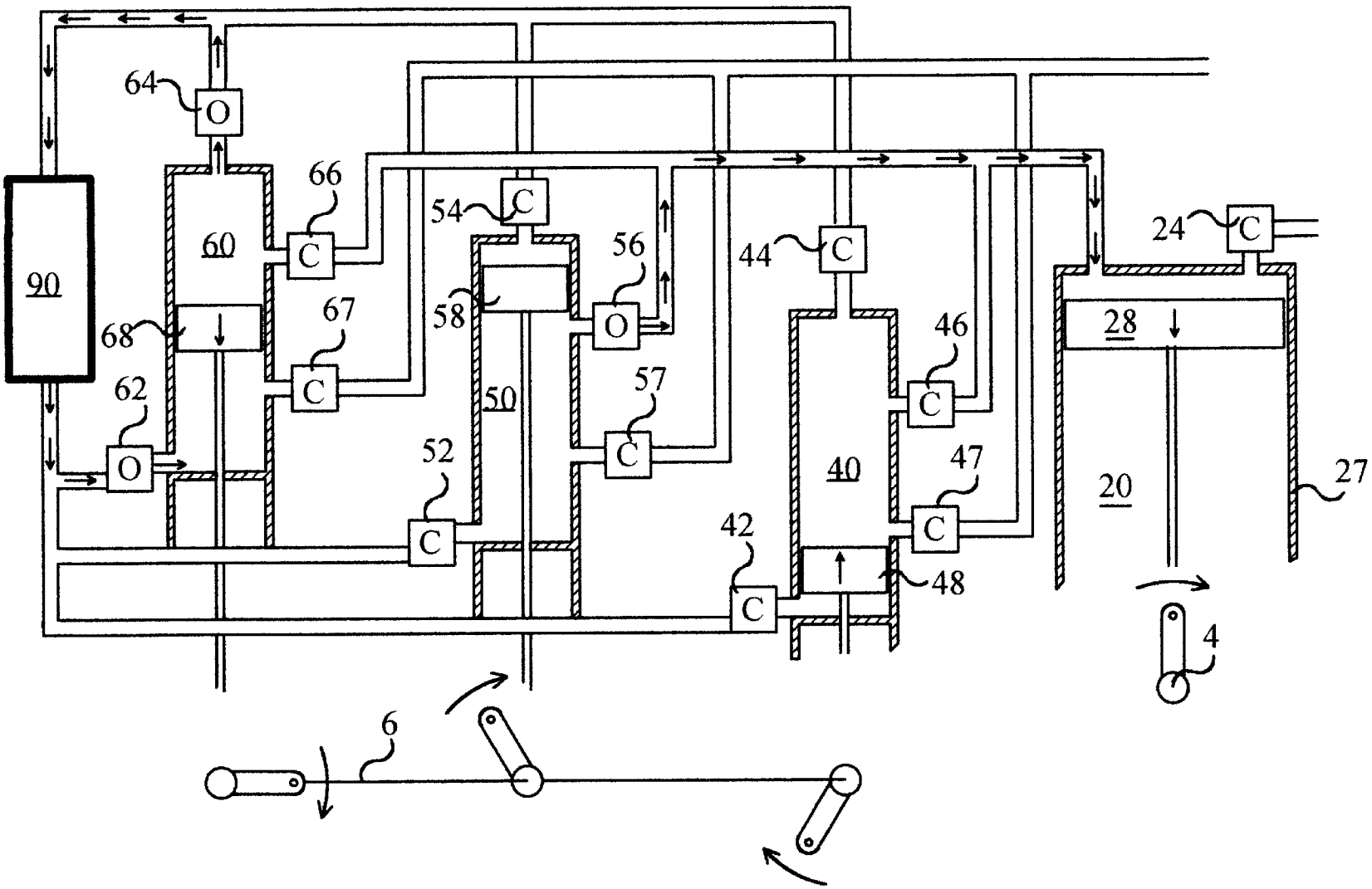

FIG. 11 shows a simplified version of the first alternate embodiment of the Multiple Heat Exchanging Chamber Engine at the start of an expansion cycle with hot working fluid coming from heat exchanging chamber 50 to drive power piston 28, movable heat exchanger 68 continues to be heated by the heating fluid in heat exchanging chamber 60, and compressed working fluid is being heated in heat exchanging chamber 40.

Figure 12:
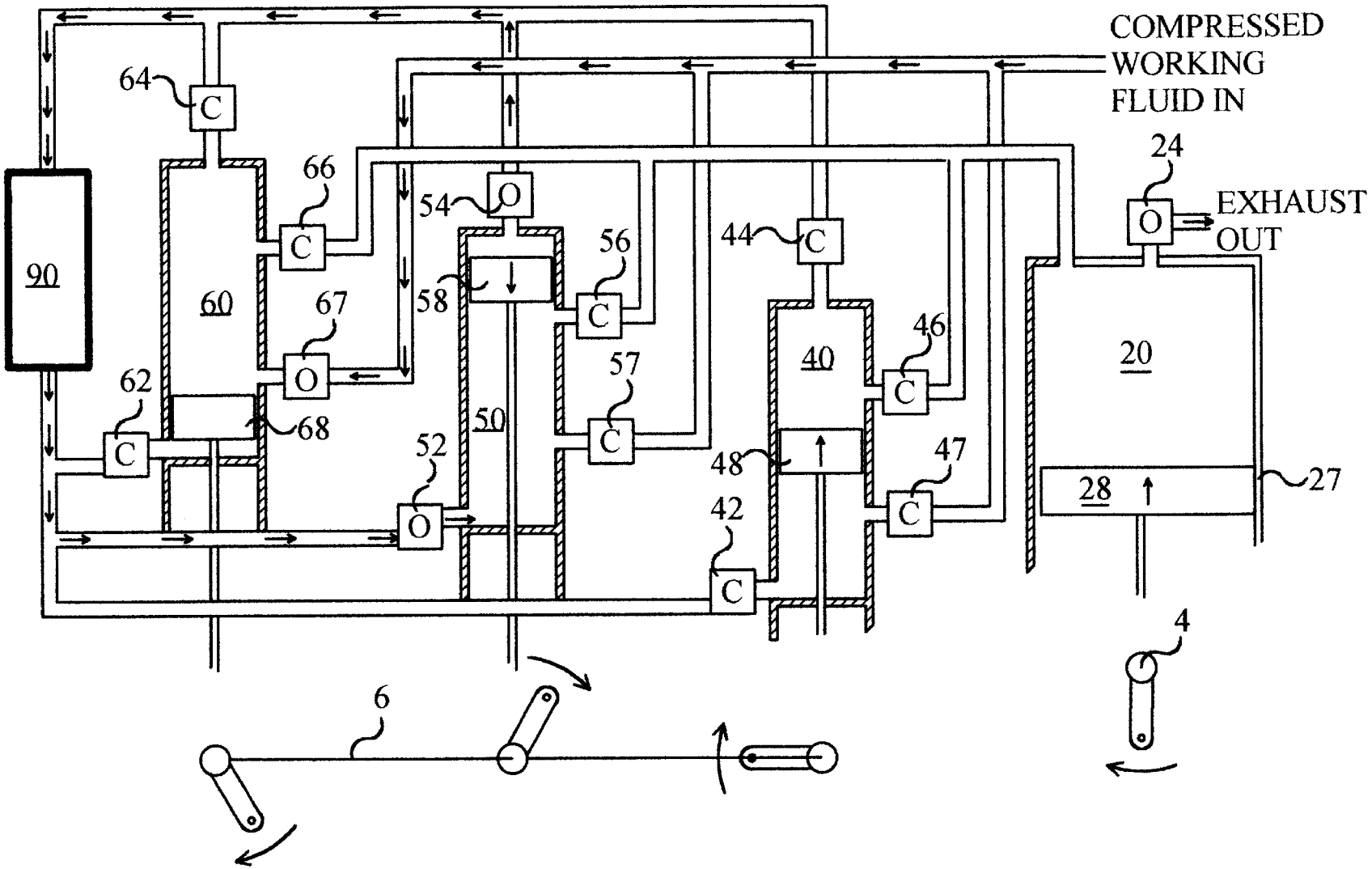

FIG. 12 shows a simplified version of the first alternate embodiment of the Multiple Heat Exchanging Chamber Engine at the start of an exhaust cycle with compressed working fluid going into heat exchanging chamber 60, movable heat exchanger 58 is being heated by the heating fluid in heat exchanging chamber 50, and compressed working fluid continues to be heated in heat exchanging chamber 40.

Figure 13:
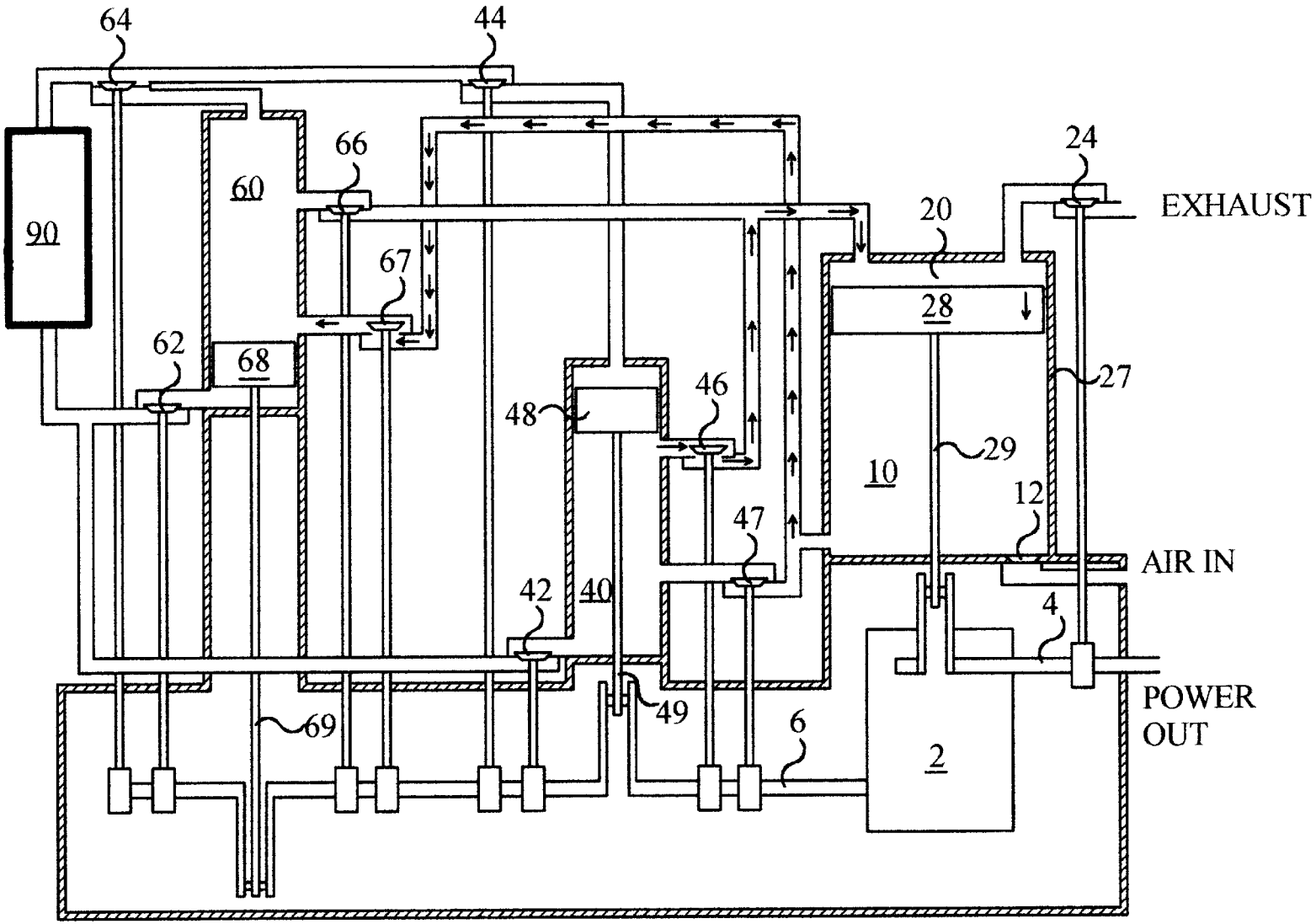

FIG. 13 depicts in detail the second alternate embodiment of the Multiple Heat Exchanging Chamber Engine at the start of an expansion cycle. This embodiment of the Multiple Heat Exchanging Chamber Engine has the compressor contained in the same cylinder as the expander. It works with any even number of heat exchanging chambers. Hot working fluid is coming from heat exchanging chamber 40 to drive power piston 28, and compressed working fluid is going into heat exchanging chamber 60.

Figure 14:
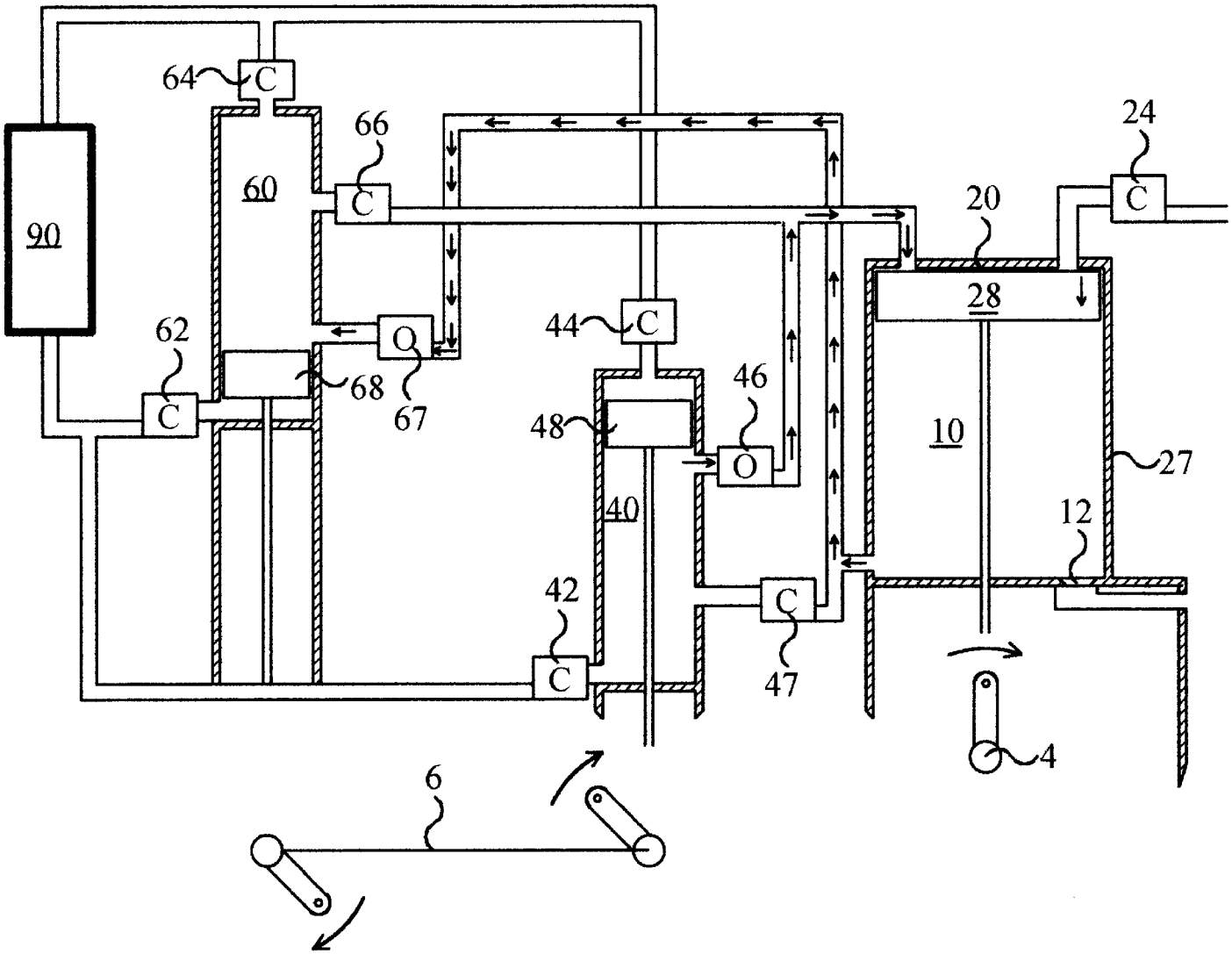

FIG. 14 shows a simplified version of the second alternate embodiment of the Multiple Heat Exchanging Chamber Engine at the start of an expansion cycle. Hot working fluid is coming from heat exchanging chamber 40 to drive power piston 28, and compressed working fluid is going into heat exchanging chamber 60.

Figure 15:
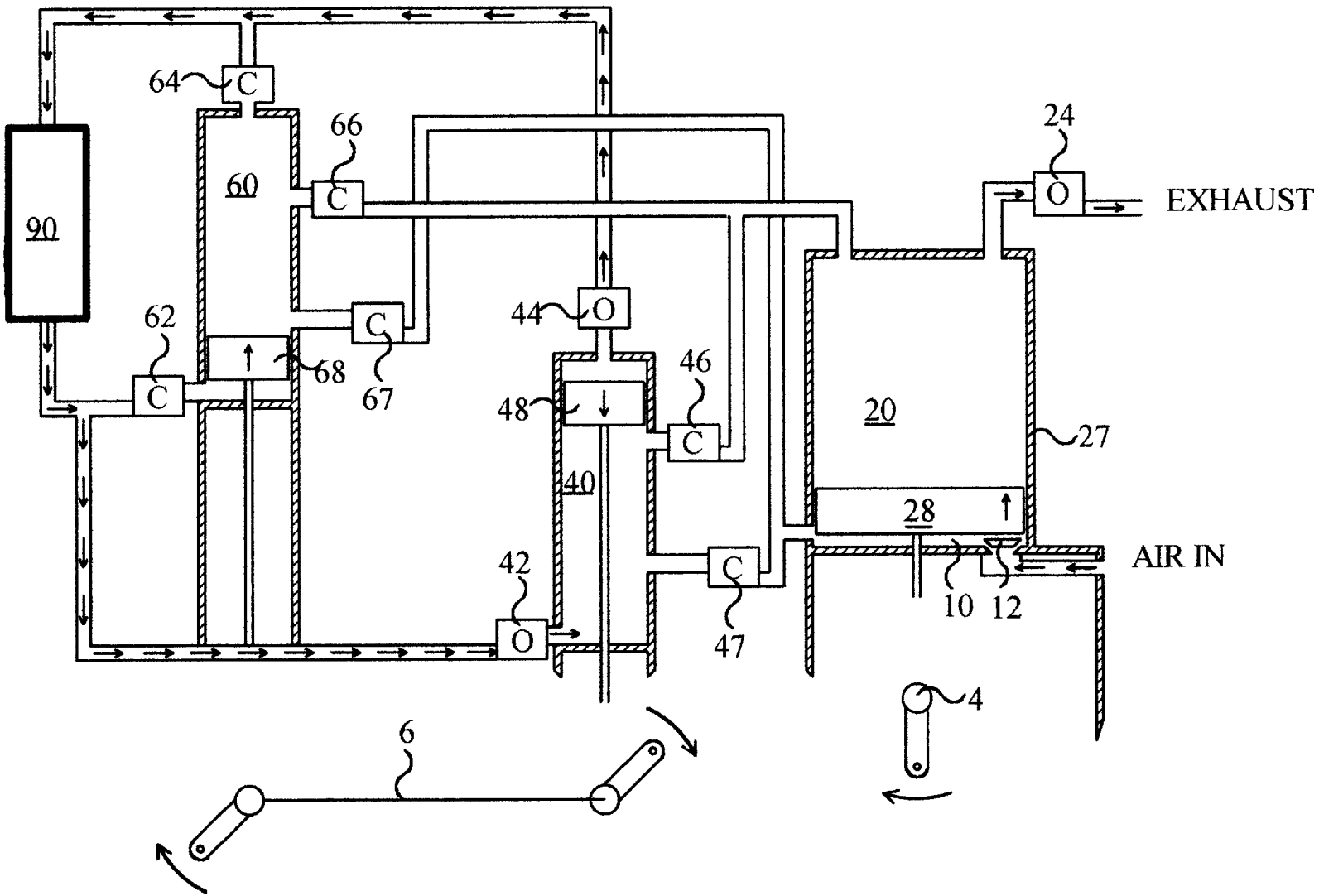

FIG. 15 shows a simplified version of the second alternate embodiment of the Multiple Heat Exchanging Chamber Engine at the start of an exhaust cycle. Movable heat exchanger 48 is being heated by the heating fluid in heat exchanging chamber 40, and compressed working fluid is being heated in heat exchanging chamber 60.

Figure 16:
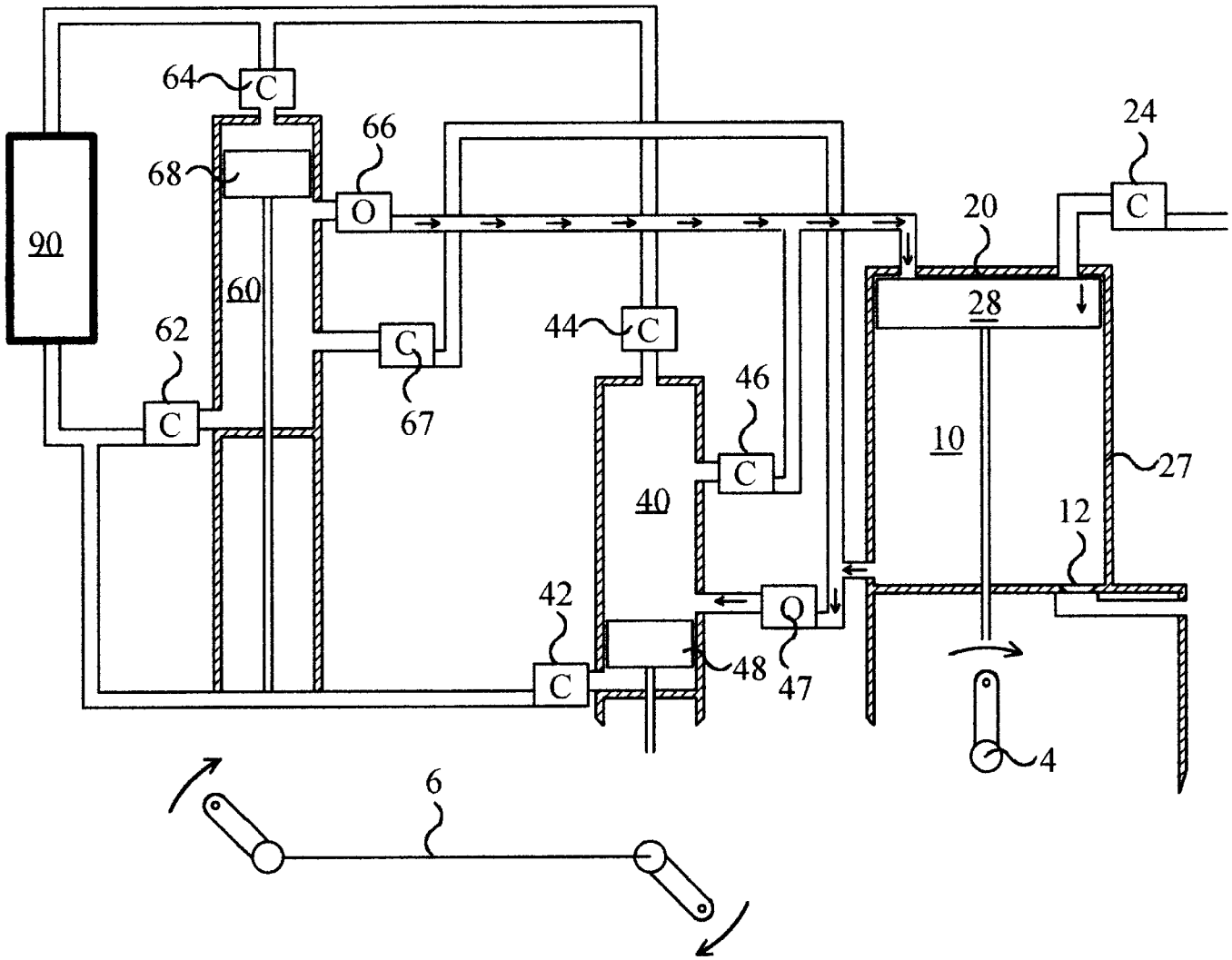

FIG. 16 shows a simplified version of the second alternate embodiment of the Multiple Heat Exchanging Chamber Engine at the start of an expansion cycle. Hot working fluid is coming from heat exchanging chamber 60 to drive power piston 28, and compressed working fluid is going into heat exchanging chamber 40.

Figure 17:
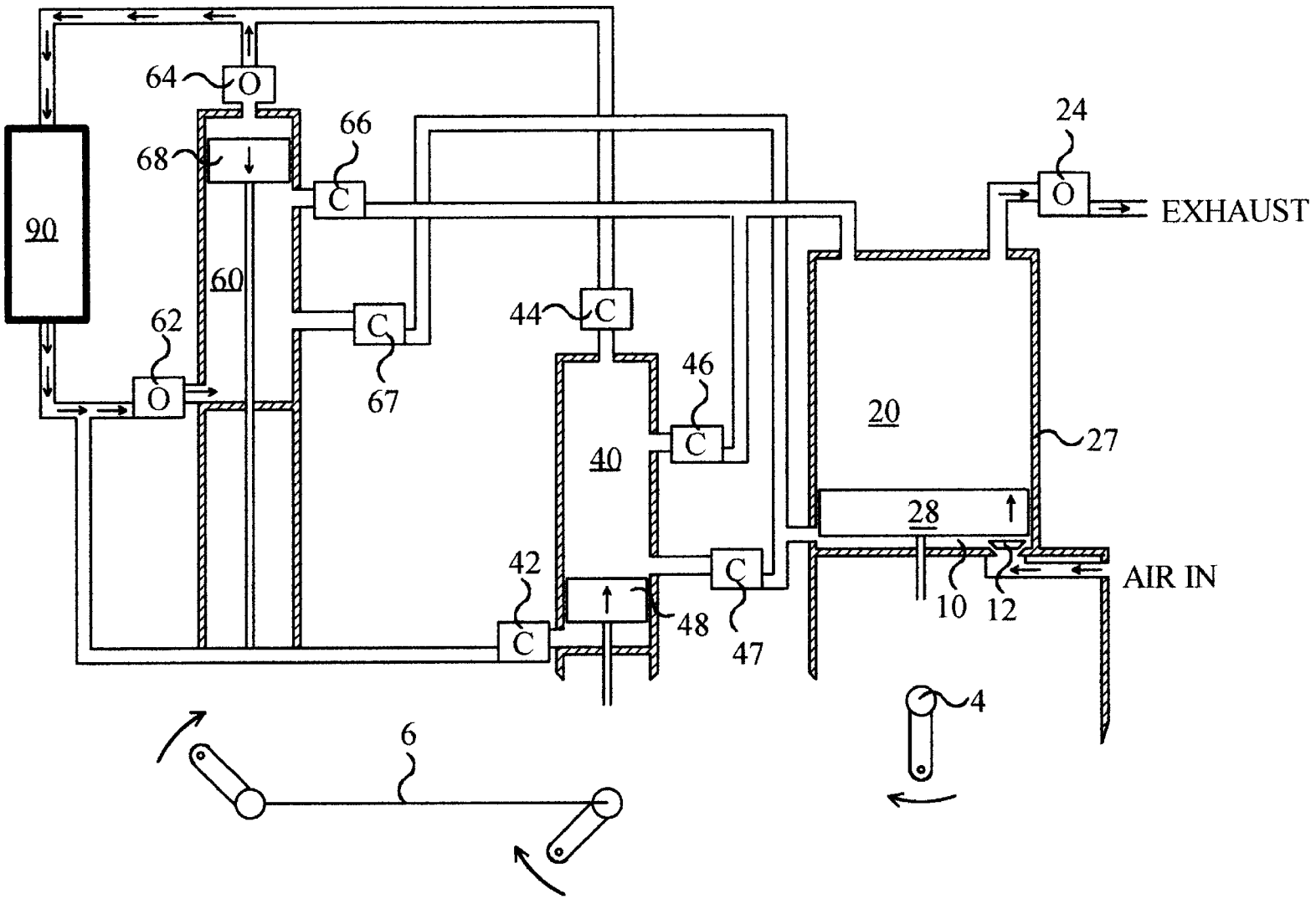

FIG. 17 shows a simplified version of the second alternate embodiment of the Multiple Heat Exchanging Chamber Engine at the start of an exhaust cycle. Movable heat exchanger 68 is being heated by the heating fluid in heat exchanging chamber 60, and compressed working fluid is being heated in heat exchanging chamber 40.

Figure 18:
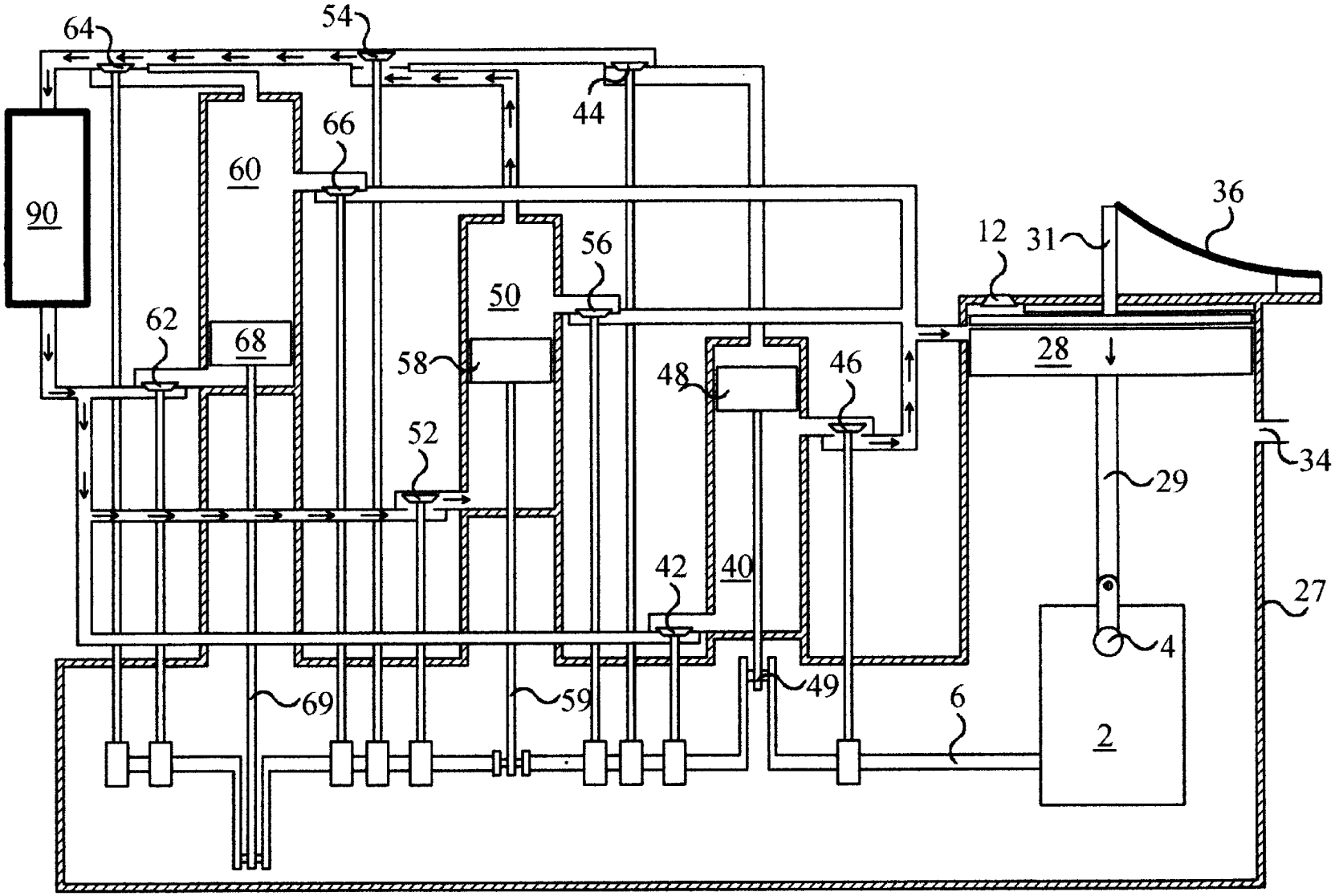

FIG. 18 depicts in detail the third alternate embodiment of the Multiple Heat Exchanging Chamber Engine at the start of an expansion cycle. This embodiment of the Multiple Heat Exchanging Chamber Engine has the compressor contained in the same cylinder as the expander. It works with any odd number of heat exchanging chambers. Hot working fluid is coming from heat exchanging chamber 40 to drive power piston 28, movable heat exchanger 58 is being heated by the heating fluid in heat exchanging chamber 50, and compressed working fluid is being heated in heat exchanging chamber 60.

Figure 19:
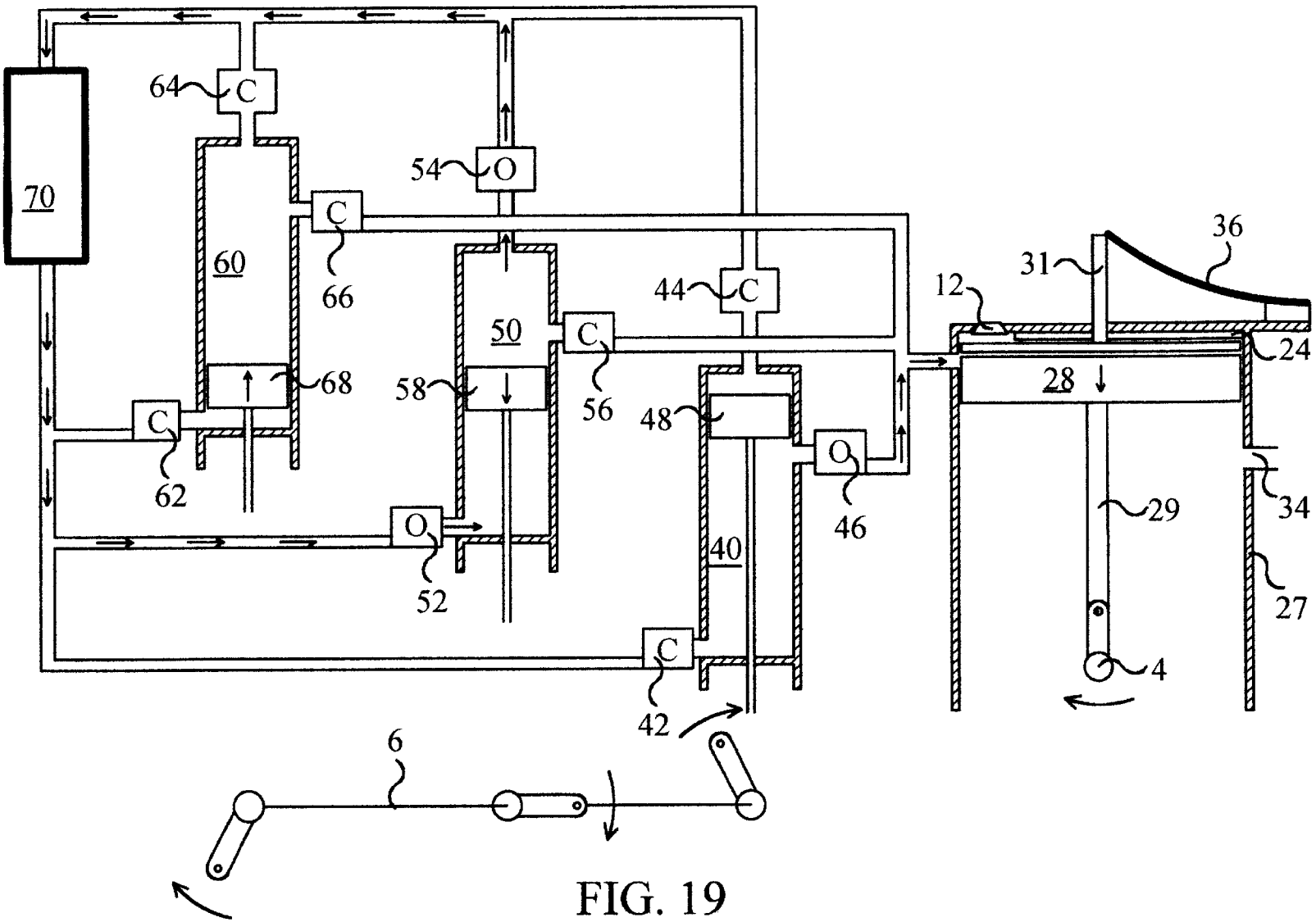

FIG. 19 shows a simplified version of the third alternate embodiment of the Multiple Heat Exchanging Chamber Engine at the start of an expansion cycle with hot working fluid coming from heat exchanging chamber 40 to drive power piston 28, movable heat exchanger 58 continues to be heated by the heating fluid in heat exchanging chamber 50, and compressed working fluid is being heated in heat exchanging chamber 60.

Figure 20:
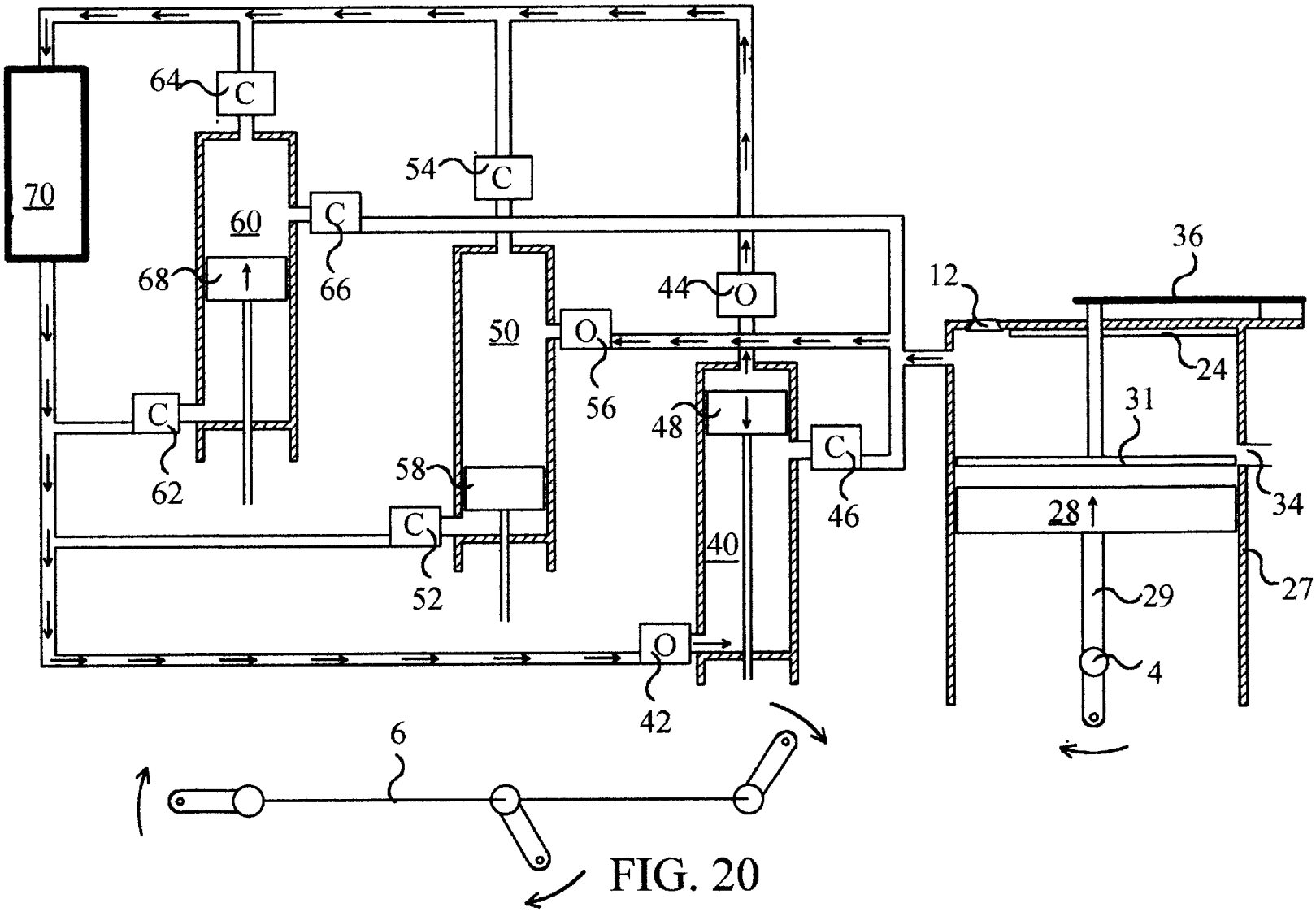

FIG. 20 shows a simplified version of the third alternate embodiment of the Multiple Heat Exchanging Chamber Engine at the end of the exhaust cycle. When power piston 28 covers exhaust port 34 compressed working fluid will go into heat exchanging chamber 50, movable heat exchanger 48 is being heated by the heating fluid in heat exchanging chamber 40, and compressed working fluid continues to be heated in heat exchanging chamber 60.

Figure 21:
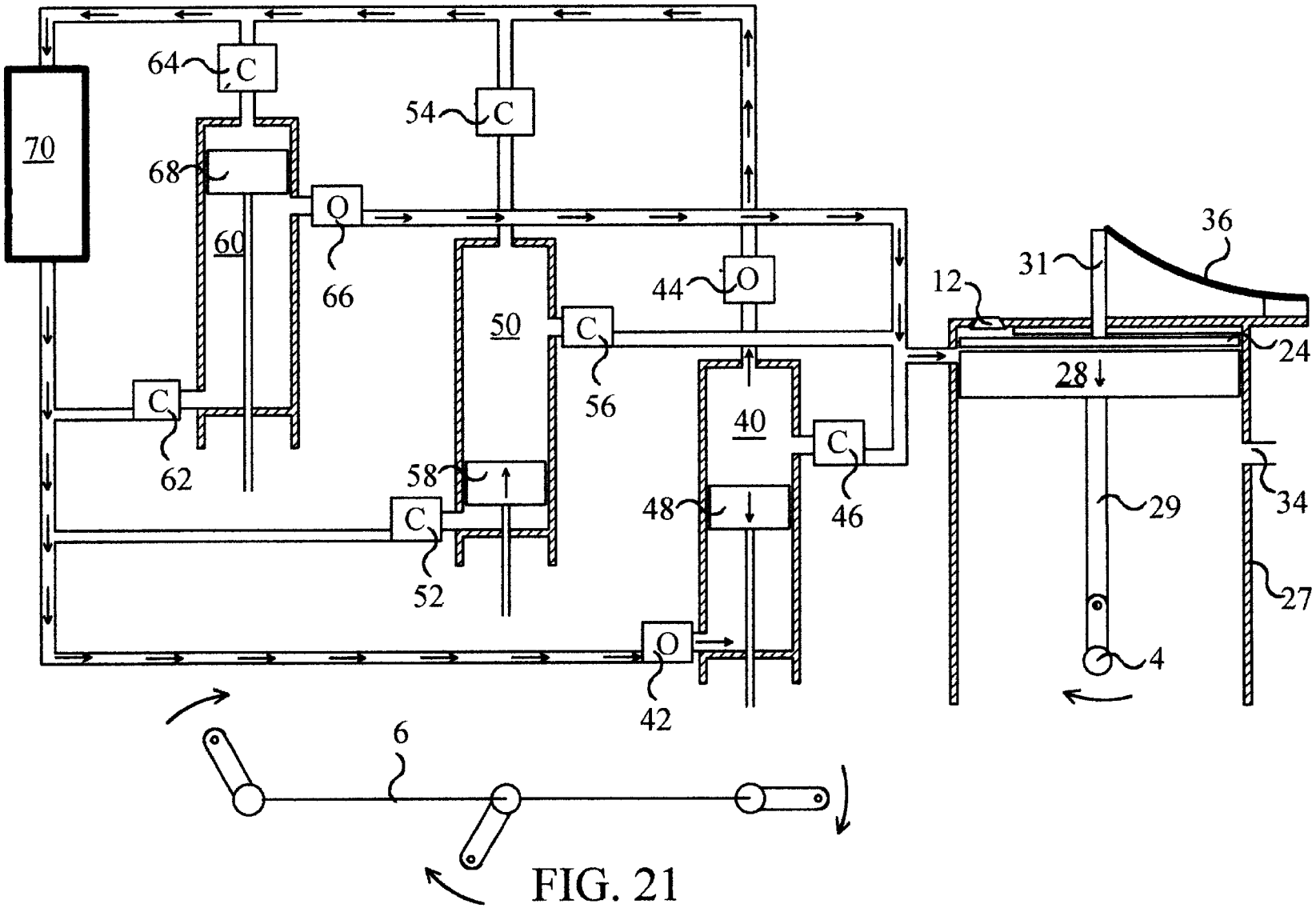

FIG. 21 shows a simplified version of the third alternate embodiment of the Multiple Heat Exchanging Chamber Engine at the start of an expansion cycle with hot working fluid coming from heat exchanging chamber 60 to drive power piston 28, movable heat exchanger 48 continues to be heated by the heating fluid in heat exchanging chamber 40, and compressed working fluid is being heated in heat exchanging chamber 50.

Figure 22:
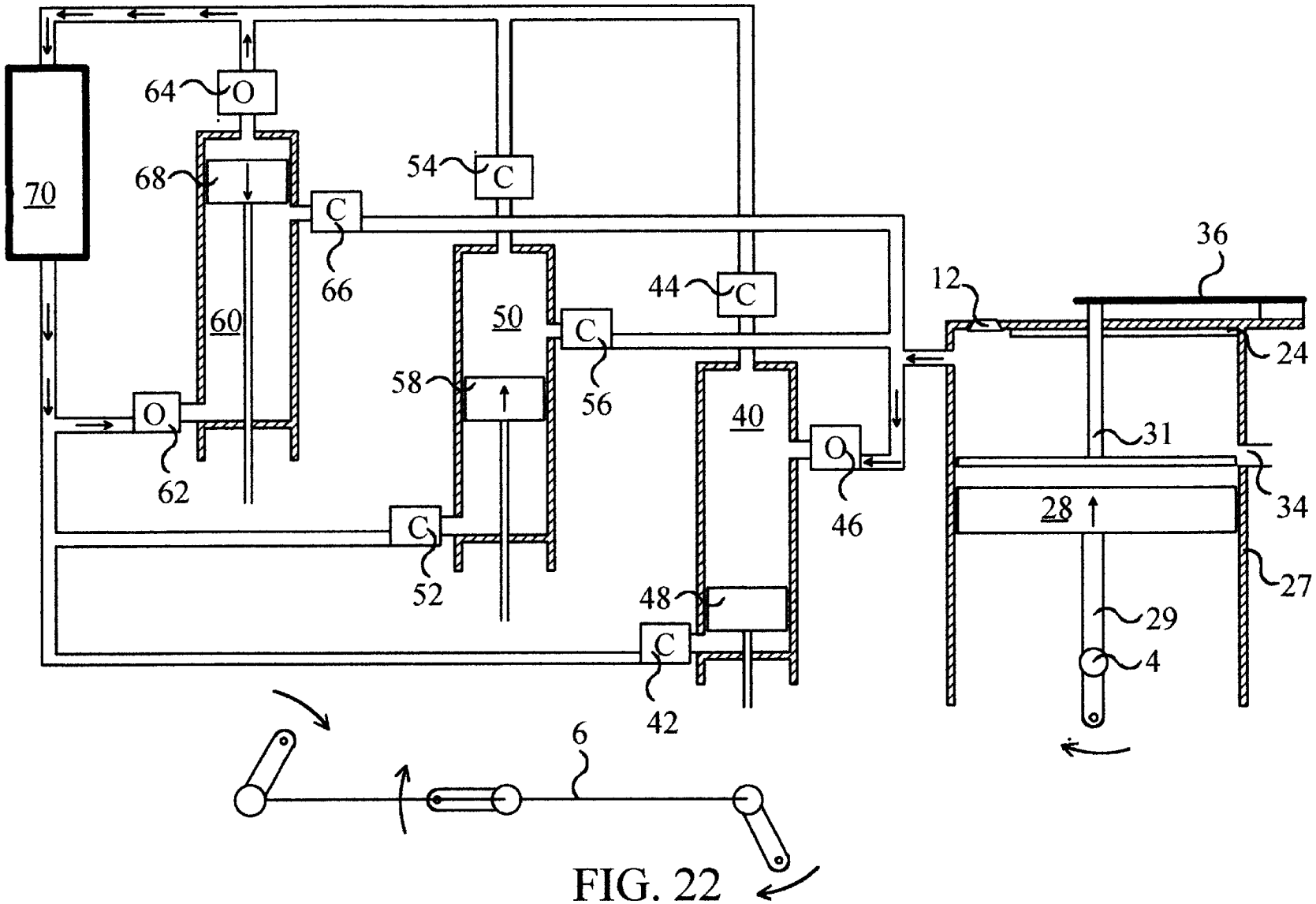

FIG. 22 shows a simplified version of the third alternate embodiment of the Multiple Heat Exchanging Chamber Engine at the end of the exhaust cycle. When power piston 28 covers exhaust port 34 compressed working fluid will go into heat exchanging chamber 40, movable heat exchanger 68 is being heated by the heating fluid in heat exchanging chamber 60, and compressed working fluid continues to be heated in heat exchanging chamber 50.

Figure 23:
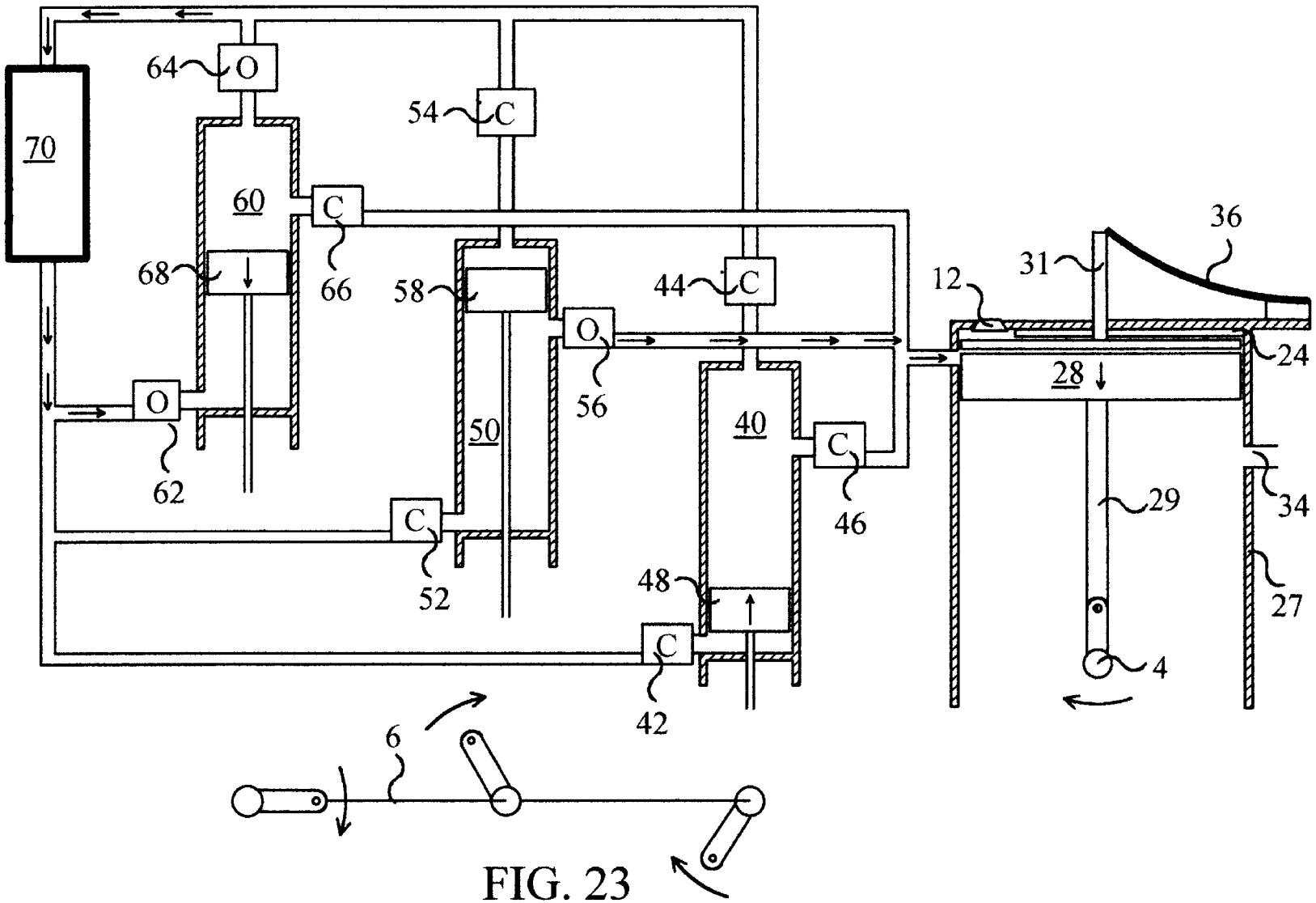

FIG. 23 shows a simplified version of the third alternate embodiment of the Multiple Heat Exchanging Chamber Engine at the start of an expansion cycle with hot working fluid coming from heat exchanging chamber 50 to drive power piston 28, movable heat exchanger 68 continues to be heated by the heating fluid in heat exchanging chamber 60, and compressed working fluid is being heated in heat exchanging chamber 40.

Figure 24:
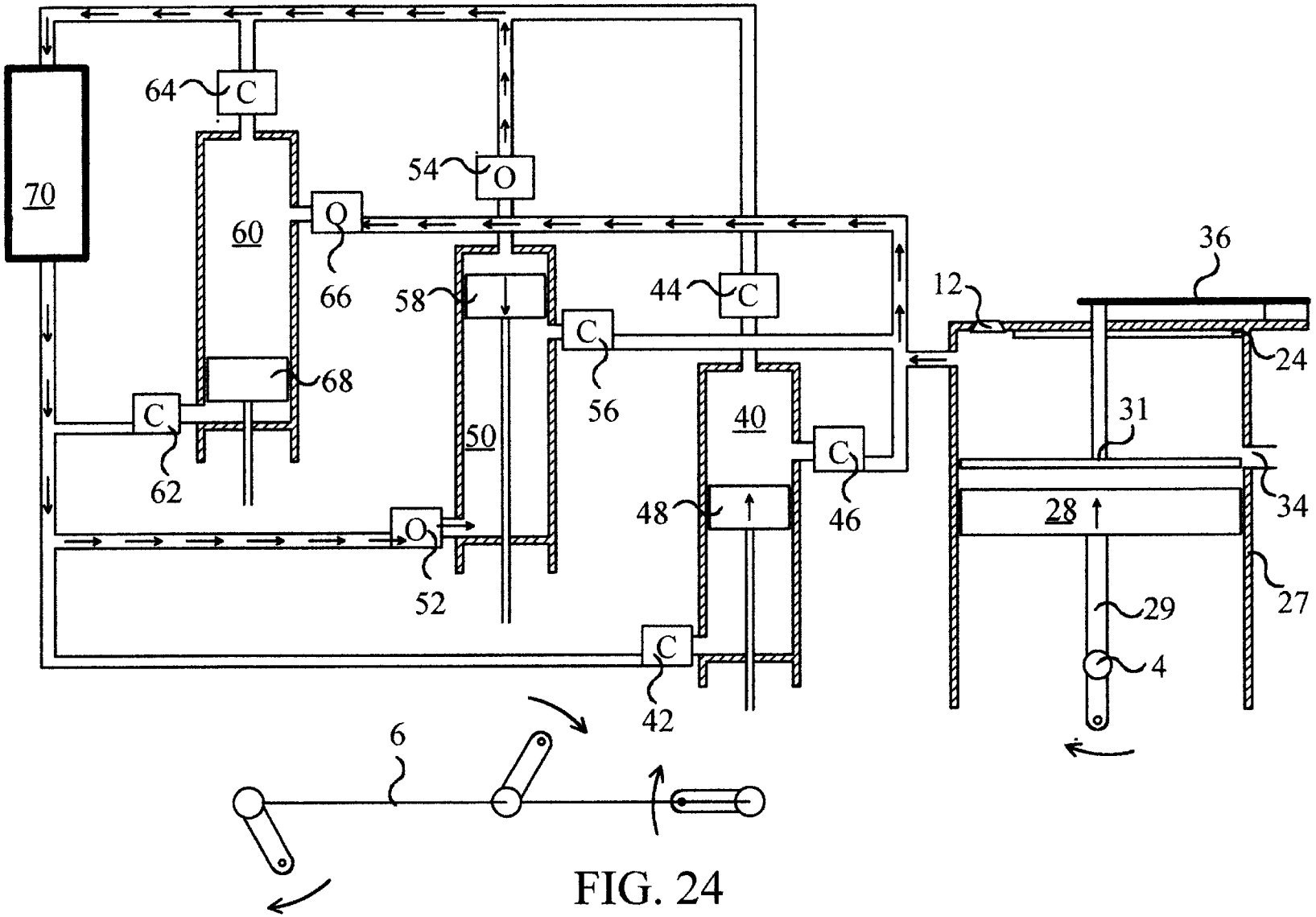

FIG. 24 shows a simplified version of the third alternate embodiment of the Multiple Heat Exchanging Chamber Engine at the end of the exhaust cycle. When power piston 38 covers exhaust port 34 compressed working fluid will go into heat exchanging chamber 60, movable heat exchanger 58 is being heated by the heating fluid in heat exchanging chamber 50, and compressed working fluid continues to be heated in heat exchanging chamber 40.

REFERENCE NUMERALS IN DRAWINGS

2 gear box
4 power output shaft
6 low speed shaft
10 compressor
12 air inlet valve
20 expander
24 exhaust valve
27 cylinder
28 power piston
29 connecting rod
31 displacer
34 exhaust port
36 spring
40 heat exchanging chamber
41 water injector
42 heating fluid inlet valve
44 heating fluid exit valve
46 expander transfer valve
47 compressor transfer valve
48 movable heat exchanger
49 connecting rod
50 heat exchanging chamber
52 heating fluid inlet valve
54 heating fluid exit valve
56 expander transfer valve
57 compressor transfer valve
58 movable heat exchanger
59 connecting rod
60 heat exchanging chamber
61 water injector
62 heating fluid inlet valve
64 heating fluid exit valve
66 expander transfer valve
67 compressor transfer valve
68 movable heat exchanger
69 connecting rod
90 heat source

DESCRIPTION OF THE MULTIPLE HEAT EXCHANGING CHAMBER ENGINE

This Multiple Heat Exchanging Chamber Engine (shown in FIG. 1) is a two stroke, external combustion, reciprocating, engine comprised of a commercial compressor (not shown), a commercial storage tank (not shown), a heat source 90, a power output shaft 4 and similar working units made up of two or more of heat exchanging chambers 40, 60, etc, and an expander 20. In alternate embodiments of the Multiple Heat Exchanging Chamber Engine the compressor 10 and expander 20 are combined in cylinder 27.

There can be any number of heat exchanging chambers. Each of the heat exchanging chambers contains a movable heat exchanger, a heating fluid inlet valve, a heating fluid exit valve, an expander transfer valve, a compressor transfer valve, and a water injector. The movable heat exchangers and the heat exchanging chamber valves are moved by a low speed shaft 6 driven through a gear box 2 from expander 20. The speed of low speed shaft 6 and hence the gear ratio of gear box 2 is determined by the number of heat exchanging chambers. The ratio of the speed of low speed shaft 6 to the speed of power output shaft 4 is one divided by the number of heat exchanging chambers; therefore in an engine with two heat exchanging chambers, low speed shaft 6 would travel at one half the speed of power output shaft 4, and likewise an engine with nine heat exchanging chambers would have low speed shaft 6 traveling at one ninth the speed of power output shaft 4.

The working fluid that is expected to be employed in this Multiple Heat Exchanging Chamber Engine is air; however, this working fluid could be any gas or any mixture of gases and, after water injection, steam. The working fluid is sometimes referred to as air, or as the charge. After expansion the charge is referred to as exhaust gases. The heating fluid may be any gas, or combination of gases including air. FIGS. 1–24 illustrate schematically an external combustion engine suitable for practice of this invention. Only one set of components for such an engine is illustrated; however, what is illustrated will function as a complete engine if it has an inertial load. It will be understood that this is merely representative of one set of components. A plurality of such structures joined together would make up a larger engine. Other portions of the engine are conventional. Thus, the bearings, seals etc. of the engine are not specifically illustrated. The valves illustrated are but one type out of many that could be used.

The preferred embodiment of the Multiple Heat Exchanging Chamber Engine is shown with water injection. It will operate without water injection. The other embodiments of the Multiple Heat Exchanging Chamber Engine are shown without water injection, but they can also be operated with water injection for increased power output.

The engine can be operated in a closed cycle operation (where the working fluid being exhausted is cooled, water removed, compressed, and returned). And the heater can be operated closed cycle (where the heating fluid is returned). The engine can be operated in a closed cycle operation for the working fluid and open cycle operation for the heating fluid. The engine can be operated in an open cycle operation for the working fluid and closed cycle operation for the heating fluid. Of course the engine can be operated in an open cycle operation for the working fluid and an open cycle operation for the heating fluid.

FIGS. 1 to 5—Description of Preferred Embodiment

This Multiple Heat Exchanging Chamber Engine is a two stroke, external combustion, reciprocating, engine. FIG. 1, the preferred embodiment of the Multiple Heat Exchanging Chamber Engine, is an engine comprised of a heat source 90, commercial compressor (not shown), a commercial storage tank (not shown), a power output shaft 4 and similar working units made up of two heat exchanging chambers 40 and 60, and an expander 20. The compressor is any compressor that can compress a fluid such as air. It can be a piston type, rotary, etc. and more important, it can be an isothermal compressor. The storage tank is to smooth out the pressure supply, and to make sure an adequate supply of working fluid is available to heat exchanging chambers 40 and 60. Heat source 90 is anything that provides a hot heating fluid. Heat exchanging chamber 40 contains four valves: heating fluid inlet valve 42 which allows the heating fluid into heat exchanging chamber 40; heating fluid exit valve 44 which allows the heating fluid out; compressor transfer valve 47 which allows compressed working fluid in; and expander transfer valve 46 which allows hot working fluid out. Heat exchanging chamber 40 also contains a water injector 41 and movable heat exchanger 48 which is heated by the heating fluid as it moves toward heating fluid inlet valve 42 and heats the compressed working fluid as it moves away from heating fluid inlet valve 42. Movable heat exchanger 48 is moved by low speed shaft 6 through connecting rod 49. Heat exchanging chamber 60 is the same as heat exchanging chamber 40 it also contains four valves: heating fluid inlet valve 62 which allows the heating fluid in; heating fluid exit valve 64 which allows the heating fluid out; compressor transfer valve 67 which allows compressed working fluid in; and expander transfer valve 66 which allows hot working fluid out. Heat exchanging chamber 60 also contains water injector 61 and movable heat exchanger 68 which is heated by the heating fluid as it moves toward heating fluid inlet valve 62 and heats the compressed working fluid as it moves away from heating fluid inlet valve 62. Movable heat exchanger 68 is moved by low speed shaft 6 through connecting rod 69. Expander 20 is cylinder 27 that is closed at one end, and contains exhaust valve 24, power piston 28, connecting rod 29, and power output shaft 4 which powers gear box 2, low speed shaft 6, and whatever load (not shown) is attached.

FIGS. 1 to 5—Operation of Preferred Embodiment

FIG. 1 depicts in detail the preferred embodiment of the Multiple Heat Exchanging Chamber Engine. To describe the operation of the individual sequence of the heat exchanging chambers, simplified versions of the preferred embodiment of the Multiple Heat Exchanging Chamber Engine FIGS. 2 to 5 will be used.

FIG. 2 is a simplified version of FIG. 1 with less lines, and shows the positions of low speed shaft 6 and power output shaft 4. FIG. 2 shows the Multiple Heat Exchanging Chamber Engine at the start of an expansion cycle with compressed working fluid moving into heat exchanging chamber 60 through compressor transfer valve 67. Movable heat exchanger 68 stays near the bottom of heat exchanging chamber 60 as it moves to the bottom and back up a little way. Hot working fluid is coming from heat exchanging chamber 40. Movable heat exchanger 48 stays near the top of heat exchanging chamber 40 as it moves to the top and back down a little way. The hot working fluid moves into expander 20 and forces power piston 28 down providing output power via connecting rod 29 and power output shaft 4.

FIG. 3 shows the Multiple Heat Exchanging Chamber Engine at the end of the above expansion cycle. Power piston 28 will move up and exhaust the spent working fluid through exhaust valve 24. The heating fluid, coming in heating fluid inlet valve 42 and flowing through heat exchanging chamber 40 and out heating fluid exit valve 44, heats up movable heat exchanger 48 as movable heat exchanger 48 moves towards heating fluid inlet valve 42. In heat exchanging chamber 60 water injection takes place, and hot movable heat exchanger 68 moves through the steam and compressed working fluid heating them up.

FIG. 4 shows the Multiple Heat Exchanging Chamber Engine at the start of another expansion cycle with compressed working fluid moving into heat exchanging chamber 40 through compressor transfer valve 47. Movable heat exchanger 48 stays near the bottom of heat exchanging chamber 40 as it moves to the bottom and back up a little way. Hot working fluid is coming from heat exchanging chamber 60. Movable heat exchanger 68 stays near the top of heat exchanging chamber 60 as it moves to the top and back down a little way. The hot working fluid moves into expander 20 and forces power piston 28 down providing output power via connecting rod 29 and power output shaft 4.

FIG. 5 shows the Multiple Heat Exchanging Chamber Engine at the end of the above expansion cycle. Power piston 28 will move up and exhaust the spent working fluid through exhaust valve 24. The heating fluid, coming in heating fluid inlet valve 62 and flowing through heating heat exchanging chamber 60 and out heating fluid exit valve 64, heats up movable heat exchanger 68 as movable heat exchanger 68 moves towards heating fluid inlet valve 62. In heat exchanging chamber 40 water injection takes place, and hot movable heat exchanger 48 moves through the steam and compressed working fluid heating them up.

Description—FIGS. 6 to 12—First Alternate Embodiment

FIG. 6, the first alternate embodiment of the Multiple Heat Exchanging Chamber Engine, is shown to illustrate that the engine can have any number of heat exchanging chambers by adding the heat exchanging chambers and changing the gear box ratio. It is an engine comprised of a heat source 90, commercial compressor (not shown), a commercial storage tank (not shown), a power output shaft 4 and similar working units made up of three heat exchanging chambers 40, 50 and 60, and an expander 20. The compressor is any compressor that can compress a fluid such as air. It can be a piston type, rotary, etc. and more important, it can be an isothermal compressor. The storage tank is to smooth out the pressure supply, and to make sure an adequate supply of working fluid is available to heat exchanging chambers 40, 50 and 60. Heat source 90 is anything that provides a hot heating fluid. Heat exchanging chamber 40 contains four valves: heating fluid inlet valve 42 which allows the heating fluid into heat exchanging chamber 40; heating fluid exit valve 44 which allows the heating fluid out; compressor transfer valve 47 which allows compressed working fluid in; and expander transfer valve 46 which allows hot working fluid out. Heat exchanging chamber 40 also movable heat exchanger 48 which is heated by the heating fluid as it moves toward heating fluid inlet valve 42 and heats the compressed working fluid as it moves away from heating fluid inlet valve 42. Movable heat exchanger 48 is moved by low speed shaft 6 through connecting rod 49. Heat exchanging chamber 50 is the same as heat exchanging chamber 40 it also contains four valves: heating fluid inlet valve 52 which allows the heating fluid in; heating fluid exit valve 54 which allows the heating fluid out; compressor transfer valve 57 which allows compressed working fluid in; and expander transfer valve 56 which allows hot working fluid out. Heat exchanging chamber 50 also movable heat exchanger 58 which is heated by the heating fluid as it moves toward heating fluid inlet valve 52 and heats the compressed working fluid as it moves away from heating fluid inlet valve 52. Movable heat exchanger 58 is moved by low speed shaft 6 through connecting rod 59. Heat exchanging chamber 60 is the same as heat exchanging chamber 40 it also contains four valves: heating fluid inlet valve 62 which allows the heating fluid in; heating fluid exit valve 64 which allows the heating fluid out; compressor transfer valve 67 which allows compressed working fluid in; and expander transfer valve 66 which allows hot working fluid out. Heat exchanging chamber 60 also contains movable heat exchanger 68 which is heated by the heating fluid as it moves toward heating fluid inlet valve 62 and heats the compressed working fluid as it moves away from heating fluid inlet valve 62. Movable heat exchanger 68 is moved by low speed shaft 6 through connecting rod 69. Expander 20 is cylinder 27 that is closed at one end, and contains exhaust valve 24, power piston 28, connecting rod 29, and power output shaft 4 which powers gear box 2, low speed shaft 6, exhaust valve 24, and whatever load (not shown) is attached.

FIGS. 6 to 12—Operation of the First Alternate Embodiment

FIG. 6 depicts in detail the first alternate embodiment of the Multiple Heat Exchanging Chamber Engine. To describe the operation of the individual sequence of the heat exchanging chambers, simplified versions of the first alternate embodiment of the Multiple Heat Exchanging Chamber Engine FIGS. 7 to 12 will be used.

FIG. 7 is a simplified version of FIG. 6 with less lines, and shows the positions of low speed shaft 6 and power output shaft 4. FIG. 7 shows the Multiple Heat Exchanging Chamber Engine at the start of an expansion cycle with hot working fluid coming from heat exchanging chamber 40. Movable heat exchanger 48 moves to the top of heat exchanging chamber 40 and back down a little way; thus it stays near the top of heat exchanging chamber 40. The hot working fluid moves into expander 20 and forces power piston 28 down providing output power via power output shaft 4. In heat exchanging chamber 50, movable heat exchanger 58 continues to move through the hot heating fluid. In heat exchanging chamber 60, hot movable heat exchanger 68 moves through and heats the compressed working fluid.

FIG. 8 shows the Multiple Heat Exchanging Chamber Engine at the end of the above expansion cycle. Power piston 28 will move up and exhaust the spent working fluid through exhaust valve 24. The heating fluid, coming in heating fluid inlet valve 42 and flowing through heat exchanging chamber 40 and out heating fluid exit valve 44, heats up movable heat exchanger 48 as movable heat exchanger 48 moves towards heating fluid inlet valve 42. In heat exchanging chamber 50 compressed working fluid moves in through compressor transfer valve 57. Movable heat exchanger 58 moves to the bottom of heat exchanging chamber 50 and back up a little way; thus it stays near the bottom of heat exchanging chamber 50. In heat exchanging chamber 60, hot movable heat exchanger 68 continues to move through and heat the compressed working fluid.

FIG. 9 shows the Multiple Heat Exchanging Chamber Engine at the start of another expansion cycle with hot working fluid coming from heat exchanging chamber 60. Movable heat exchanger 68 moves to the top of heat exchanging chamber 60 and back down a little way; thus it stays near the top of heat exchanging chamber 60. The hot working fluid moves into expander 20 and forces power piston 28 down providing output power via power output shaft 4. In heat exchanging chamber 40, movable heat exchanger 48 continues to move through the hot heating fluid. In heat exchanging chamber 50, hot movable heat exchanger 58 moves through and heats the compressed working fluid.

FIG. 10 shows the Multiple Heat Exchanging Chamber Engine at the end of the above expansion cycle. Power piston 28 will move up and exhaust the spent working fluid through exhaust valve 24. The heating fluid, coming in heating fluid inlet valve 62 and flowing through heat exchanging chamber 60 and out heating fluid exit valve 64, heats up movable heat exchanger 68 as movable heat exchanger 68 moves towards heating fluid inlet valve 62. In heat exchanging chamber 40 compressed working fluid moves in through compressor transfer valve 47. Movable heat exchanger 48 moves to the bottom of heat exchanging chamber 40 and back up a little way; thus it stays near the bottom of heat exchanging chamber 40. In heat exchanging chamber 50, hot movable heat exchanger 58 continues to move through and heat the compressed working fluid.

FIG. 11 shows the Multiple Heat Exchanging Chamber Engine at the start of an expansion cycle with hot working fluid coming from heat exchanging chamber S0. Movable heat exchanger 58 moves to the top of heat exchanging chamber 50 and back down a little way; thus it stays near the top of heat exchanging chamber 50. The hot working fluid moves into expander 20 and forces power piston 28 down providing output power via power output shaft 4. In heat exchanging chamber 60, movable heat exchanger 68 continues to move through the hot heating fluid. In heat exchanging chamber 40, hot movable heat exchanger 48 moves through and heats the compressed working fluid.

FIG. 12 shows the Multiple Heat Exchanging Chamber Engine at the end of the above expansion cycle. Power piston 28 will move up and exhaust the spent working fluid through exhaust valve 24. The heating fluid, coming in heating fluid inlet valve 52 and flowing through heat exchanging chamber 50 and out heating fluid exit valve 54, heats up movable heat exchanger 58 as movable heat exchanger 58 moves towards heating fluid inlet valve 52. In heat exchanging chamber 60 compressed working fluid moves in through compressor transfer valve 67. Movable heat exchanger 68 moves to the bottom of heat exchanging chamber 60 and back up a little way; thus it stays near the bottom of heat exchanging chamber 60. In heat exchanging chamber 40, hot movable heat exchanger 48 continues to move through and heat the compressed working fluid.

FIGS. 13 to 17—Description of the Second Alternate Embodiment

FIG. 13, the second alternate embodiment of the Multiple Heat Exchanging Chamber Engine, is shown to illustrate that the engine can have both the expander and the compressor in the same cylinder. In this embodiment, the engine can have any even number of heat exchanging chambers by adding the heat exchanging chambers and changing low speed shaft 6 and the gear box ratio. This Multiple Heat Exchanging Chamber Engine is a two stroke, external combustion, reciprocating, engine. FIG. 13, the second alternate embodiment of the Multiple Heat Exchanging Chamber Engine, is comprised of a heat source 90, cylinder 27 that is closed at one end, and contains compressor 10,with air inlet valve 12, expander 20, with exhaust valve 24, power piston 28, connecting rod 29, power output shaft 4 which powers gear box 2, exhaust valve 24, and whatever load (not shown) is attached, low speed shaft 6, and two heat exchanging chambers 40 and 60. Heat source 90 is anything that provides a hot heating fluid. Heat exchanging chamber 40 contains four valves: heating fluid inlet valve 42 which allows the heating fluid into heat exchanging chamber 40; heating fluid exit valve 44 which allows the heating fluid out; compressor transfer valve 47 which allows compressed working fluid in; and expander transfer valve 46 which allows hot working fluid out. Heat exchanging chamber 40 also contains movable heat exchanger 48 which is heated by the heating fluid as it moves toward heating fluid inlet valve 42 and heats the compressed working fluid as it moves away from heating fluid inlet valve 42. Movable heat exchanger 48 is moved by low speed shaft 6 through connecting rod 49. Heat exchanging chamber 60 is the same as heat exchanging chamber 40 it also contains four valves: heating fluid inlet valve 62 which allows the heating fluid in; heating fluid exit valve 64 which allows the heating fluid out; compressor transfer valve 67 which allows compressed working fluid in; and expander transfer valve 66 which allows hot working fluid out. Heat exchanging chamber 60 also contains movable heat exchanger 68 which is heated by the heating fluid as it moves toward heating fluid inlet valve 62 and heats the compressed working fluid as it moves away from heating fluid inlet valve 62. Movable heat exchanger 68 is moved by low speed shaft 6 through connecting rod 69.

FIGS. 13 to 17—Operation of the Second Alternate Embodiment

FIG. 13 depicts in detail the second alternate embodiment of the Multiple Heat Exchanging Chamber Engine. To describe the operation of the individual sequence of the heat exchanging chambers, simplified versions of the second alternate embodiment of the Multiple Heat Exchanging Chamber Engine FIGS. 14 to 17 will be used.

FIG. 14 is a simplified version of FIG. 13 with less lines, and shows the positions of low speed shaft 6 and power output shaft 4. FIG. 14 shows the Multiple Heat Exchanging Chamber Engine at the start of an expansion cycle with compressed working fluid moving into heat exchanging chamber 60 through compressor transfer valve 67. Movable heat exchanger 68 stays near the bottom of heat exchanging chamber 60 as it moves to the bottom and back up a little way. Hot working fluid is coming from heat exchanging chamber 40. Movable heat exchanger 48 stays near the top of heat exchanging chamber 40 as it moves to the top and back down a little way. The hot working fluid moves into expander 20 and forces power piston 28 down providing output power via power output shaft 4. Power piston 28 also acts as a compressor piston compressing the air in compressor 10 into heat exchanging chamber 60 through compressor transfer valve 67.

FIG. 15 shows the Multiple Heat Exchanging Chamber Engine at the end of the above expansion cycle. Power piston 28 will move up, exhaust the spent working fluid through exhaust valve 24, and suck in fresh working fluid through air inlet valve 12. The heating fluid, coming in heating fluid inlet valve 42 and flowing through heat exchanging chamber 40 and out heating fluid exit valve 44, heats up movable heat exchanger 48 as movable heat exchanger 48 moves towards heating fluid inlet valve 42. In heat exchanging chamber 60 hot movable heat exchanger 68 moves through the compressed working fluid heating it up.

FIG. 16 shows the Multiple Heat Exchanging Chamber Engine at the start of another expansion cycle with compressed working fluid moving into heat exchanging chamber 40 through compressor transfer valve 47. Movable heat exchanger 48 stays near the bottom of heat exchanging chamber 40 as it moves to the bottom and back up a little way. Hot working fluid is coming from heat exchanging chamber 60. Movable heat exchanger 68 stays near the top of heat exchanging chamber 60 as it moves to the top and back down a little way. The hot working fluid moves into expander 20 and forces power piston 28 down providing output power via power output shaft 4. Power piston 28 also acts as a compressor piston compressing the air in compressor 10 into heat exchanging chamber 40 through compressor transfer valve 47.

FIG. 17 shows the Multiple Heat Exchanging Chamber Engine at the end of the above expansion cycle. Power piston 28 will move up and exhaust the spent working fluid through exhaust valve 24, and suck in fresh working fluid through air inlet valve 12. The heating fluid, coming in heating fluid inlet valve 62 and flowing through heating heat exchanging chamber 60 and out heating fluid exit valve 64, heats up movable heat exchanger 68 as movable heat exchanger 68 moves towards heating fluid inlet valve 62. In heat exchanging chamber 40 hot movable heat exchanger 48 moves through the compressed working fluid heating it up.

FIGS. 18 to 24—Description of the Third Alternate Embodiment

FIG. 18, the third alternate embodiment of the Multiple Heat Exchanging Chamber Engine, is shown to illustrate that the engine can have both the expander and the compressor in the same cylinder. The engine can have any odd number of heat exchanging chambers by adding the heat exchanging chambers and changing low speed shaft 6 and the gear box ratio. The third alternate embodiment of this Multiple Heat Exchanging Chamber Engine is a two stroke, external combustion, reciprocating, engine as shown in FIG. 18. It is comprised of cylinder 27 that is closed at one end, and contains air inlet valve 12, exhaust port 34, displacer 31, and power piston 28. Spring 36 is attached to cylinder 27 and when power piston 28 uncovers exhaust port 34 spring 36 moves displacer 31 down forcing out exhaust gases and sucking in fresh air through air inlet valve 12. When power piston 28 moves up displacer 31 it compresses spring 36 and the pressure inside cylinder 27 keeps displacer 31 up until power piston 28 again uncovers exhaust port 34. The third alternate embodiment of the engine also contains connecting rod 29, power output shaft 4 which powers gear box 2 and whatever load (not shown) is attached, low speed shaft 6, heat source 90, and three heat exchanging chambers 40, 50, and 60. Heat source 90 is anything that provides a hot heating fluid. Heat exchanging chamber 40 contains three valves: heating fluid inlet valve 42 which allows the heating fluid into heat exchanging chamber 40; heating fluid exit valve 44 which allows the heating fluid out; and expander transfer valve 46 which allows hot working fluid out and which also in this embodiment allows compressed working fluid in. Heat exchanging chamber 40 also contains movable heat exchanger 48 which is heated by the heating fluid as it moves toward heating fluid inlet valve 42 and heats the compressed working fluid as it moves away from heating fluid inlet valve 42. Movable heat exchanger 48 is moved by low speed shaft 6 through connecting rod 49. Heat exchanging chamber 50 is the same as heat exchanging chamber 40 it also contains three valves: heating fluid inlet valve 52 which allows the heating fluid in; heating fluid exit valve 54 which allows the heating fluid out; and expander transfer valve 56 which allows hot working fluid out and also allows compressed working fluid in. Heat exchanging chamber 50 also contains movable heat exchanger 58 which is heated by the heating fluid as it moves toward heating fluid inlet valve 52 and heats the compressed working fluid as it moves away from heating fluid inlet valve 52. Movable heat exchanger 58 is moved by low speed shaft 6 through connecting rod 59. Heat exchanging chamber 60 is the same as heat exchanging chamber 40 it also contains three valves: heating fluid inlet valve 62 which allows the heating fluid in; heating fluid exit valve 64 which allows the heating fluid out; and expander transfer valve 66 which allows hot working fluid out and also allows compressed working fluid in. Heat exchanging chamber 60 also contains movable heat exchanger 68 which is heated by the heating fluid as it moves toward heating fluid inlet valve 62 and heats the compressed working fluid as it moves away from heating fluid inlet valve 62. Movable heat exchanger 68 is moved by low speed shaft 6 through connecting rod 69.

FIGS. 18 to 24—Operation of the Third Alternate Embodiment

FIG. 18 depicts in detail the third alternate embodiment of the Multiple Heat Exchanging Chamber Engine. To describe the operation of the individual sequence of the heat exchanging chambers, simplified versions of the third alternate embodiment of the Multiple Heat Exchanging Chamber Engine FIGS. 19 to 24 will be used.

FIG. 19 is a simplified version of FIG. 18 with less lines, and shows the positions of low speed shaft 6 and power output shaft 4. FIG. 19 shows the Multiple Heat Exchanging Chamber Engine at the start of an expansion cycle with hot working fluid coming from heat exchanging chamber 40. Movable heat exchanger 48 moves to the top of heat exchanging chamber 40 and back down a little way; thus it stays near the top of heat exchanging chamber 40. The hot working fluid moves into cylinder 27 and forces power piston 28 down providing output power via connecting rod 29 and power output shaft 4. In heat exchanging chamber 50, movable heat exchanger 58 continues to move through the hot heating fluid. In heat exchanging chamber 60, hot movable heat exchanger 68 moves through and heats the compressed working fluid.

FIG. 20 shows the Multiple Heat Exchanging Chamber Engine at the end of the above expansion cycle. Displacer 31 has moved down and exhausted the spent working fluid through exhaust port 34. The heating fluid, coming in heating fluid inlet valve 42 and flowing through heat exchanging chamber 40 and out heating fluid exit valve 44, heats up movable heat exchanger 48 as movable heat exchanger 48 moves towards heating fluid inlet valve 42. In heat exchanging chamber 50 compressed working fluid from power piston 28 and displacer 31 moves in through expander transfer valve 56. Movable heat exchanger 58 moves to the bottom of heat exchanging chamber 50 and back up a little way; thus it stays near the bottom of heat exchanging chamber 50. In heat exchanging chamber 60, hot movable heat exchanger 68 continues to move through and heat the compressed working fluid.

FIG. 21 shows the Multiple Heat Exchanging Chamber Engine at the start of another expansion cycle with hot working fluid coming from heat exchanging chamber 60. Movable heat exchanger 68 moves to the top of heat exchanging chamber 60 and back down a little way; thus it stays near the top of heat exchanging chamber 60. The hot working fluid moves into cylinder 27 and forces power piston 28 down providing output power via connecting rod 29 and power output shaft 4. In heat exchanging chamber 40, movable heat exchanger 48 continues to move through the hot heating fluid. In heat exchanging chamber 50, hot movable heat exchanger 58 moves through and heats the compressed working fluid.

FIG. 22 shows the Multiple Heat Exchanging Chamber Engine at the end of the above expansion cycle. Displacer 31 has moved down and exhausted the spent working fluid through exhaust port 34. The heating fluid, coming in heating fluid inlet valve 62 and flowing through heat exchanging chamber 60 and out heating fluid exit valve 64, heats up movable heat exchanger 68 as movable heat exchanger 68 moves towards heating fluid inlet valve 62. In heat exchanging chamber 40 compressed working fluid from power piston 28 and displacer 31 moves in through expander transfer valve 46. Movable heat exchanger 48 moves to the bottom of heat exchanging chamber 40 and back up a little way; thus it stays near the bottom of heat exchanging chamber 40. In heat exchanging chamber 50, hot movable heat exchanger 58 continues to move through and heat the compressed working fluid.

FIG. 23 shows the Multiple Heat Exchanging Chamber Engine at the start of an expansion cycle with hot working fluid coming from heat exchanging chamber 50. Movable heat exchanger 58 moves to the top of heat exchanging chamber 50 and back down a little way; thus it stays near the top of heat exchanging chamber 50. The hot working fluid moves into cylinder 27 and forces power piston 28 down providing output power via connecting rod 29 and power output shaft 4. In heat exchanging chamber 60, movable heat exchanger 68 continues to move through the hot heating fluid. In heat exchanging chamber 40, hot movable heat exchanger 48 moves through and heats the compressed working fluid.

FIG. 24 shows the Multiple Heat Exchanging Chamber Engine at the end of the above expansion cycle. Displacer 31 has moved down and exhausted the spent working fluid through exhaust port 34. The heating fluid, coming in heating fluid inlet valve 52 and flowing through heat exchanging chamber 50 and out heating fluid exit valve 54, heats up movable heat exchanger 58 as movable heat exchanger 58 moves towards heating fluid inlet valve 52. In heat exchanging chamber 60 compressed working fluid from power piston 28 and displacer 31 moves in through expander transfer valve 66. Movable heat exchanger 68 moves to the bottom of heat exchanging chamber 60 and back up a little way; thus it stays near the bottom of heat exchanging chamber 60. In heat exchanging chamber 40, hot movable heat exchanger 48 continues to move through and heat the compressed working fluid.

Conclusion

Accordingly, the reader will see that the two stroke engine with displacer meets the following objects and advantages:

a.) Heat is transferred into the engine without passing through any pressurized walls.

b.) The heat transfer time can be very long.

c.) The compressed working fluid can be cooled.

d.) The engine can be operated so that the charge is almost fully expanded.

e.) The heat for the engine can be supplied by solar, nuclear, garbage furnaces, or from waste heat from an industrial process.

f.) The engine can be water injected g.) The injected water can be provided a long time to heat and vaporize.

Although the description above contains many specificities, these should not be construed as limiting the scope of the Multiple Heat Exchanging Chamber Engine but as merely providing illustrations of some of the presently preferred embodiments of this Multiple Heat Exchanging Chamber Engine.

Thus the scope of the Multiple Heat Exchanging Chamber Engine should be determined by the appended claims and their legal equivalents, rather than by the examples given.

I claim:

1. A two stroke, external combustion, reciprocating engine having one or more similar working units, each working unit comprising:

a) a first means for supplying compressed working fluid;

b) a cylinder closed at one end containing a second means for controlling the flow of spent working fluid out of said cylinder and a power piston which moves in a reciprocating manner, and is connected to a power output shaft;

c) a plurality of heat exchanging chambers;

d) a third means for supplying hot heating fluid to said heat exchanging chambers;

e) a valve for each of said heat exchanging chambers for controlling the flow of heating fluid into said heat exchanging chamber;

f) a valve for each of said heat exchanging chambers for controlling the flow of heating fluid out of said heat exchanging chamber;

g) a valve for each of said heat exchanging chambers for transferring said compressed working fluid into said heat exchanging chamber;

h) a valve for each of said heat exchanging chambers for transferring said compressed working fluid out of said heat exchanging chamber;

i) an alternating flow heat exchanger located within each of said heat exchanging chambers which moves within said heat exchanging chamber, and stores heat from the heating fluid as the alternating flow heat exchanger moves in one direction, and releases heat to the compressed working fluid as the alternating flow heat exchanger moves in the other direction;

j) a low speed shaft powered by a speed reduction device powered by said power output shaft for moving: said valves for controlling the flow of heating fluid into said heat exchanging chambers, said valves for controlling the flow of heating fluid out of said heat exchanging chambers, said valves for transferring said compressed working fluid into said heat exchanging chambers, said a valves for transferring said compressed working fluid out of said heat exchanging chambers, and said heat exchangers.

2. An engine as recited in claim 1 wherein said second means for controlling the flow of spent working fluid out of said cylinder is an exhaust valve.

3. An engine as recited in claim 1 wherein said second means for controlling the flow of spent working fluid out of said cylinder is an exhaust port.

4. An engine as recited in claim 1 wherein said first means for supplying compressed working fluid is a compressor located on the opposite side of said power piston, and a fluid inlet valve.

5. An engine as recited in claim 1 wherein said third means for supplying hot heating fluid to said heat exchanging chambers is a furnace.

6. An engine as recited in claim 1 wherein each heat exchanging chamber contains a water injector.

7. A two stroke, external combustion, reciprocating engine having one or more similar working units, each working unit comprising:

a) a cylinder closed at one end containing an air inlet valve, an exhaust port, a displacer, a fourth means to move said displacer, and a power piston connected to a power output shaft;

b) three or more odd number of heat exchanging chambers;

c) a third means for supplying hot heating fluid to said heat exchanging chambers;

d) a valve for each of said heat exchanging chambers for controlling the flow of heating fluid into said heat exchanging chamber;

e) a valve for each of said heat exchanging chambers for controlling the flow of heating fluid out of said heat exchanging chamber;

f) a valve for each of said heat exchanging chambers for transferring said compressed working fluid into and out of said heat exchanging chamber;

g) an alternating flow heat exchanger located within each of said heat exchanging chambers which moves within said heat exchanging chamber, and stores heat from the heating fluid as the alternating flow heat exchanger moves in one direction, and releases heat to the compressed working fluid as the alternating flow heat exchanger moves in the other direction;

h) a low speed shaft powered by a speed reduction device powered by said power output shaft for moving: said valves for controlling the flow of heating fluid into said heat exchanging chambers, said valves for controlling the flow of heating fluid out of said heat exchanging chambers, said valves for transferring said compressed working fluid into said heat exchanging chambers, said a valves for transferring said compressed working fluid out of said heat exchanging chambers, and said heat exchangers.

8. An engine as recited in claim 7 wherein said fourth means for moving said displacer is a spring.

9. An engine as recited in claim 7 wherein said third means for supplying hot heating fluid to said heat exchanging chambers is a furnace.

10. An engine as recited in claim 7 wherein each heat exchanging chamber contains a water injector.

11. A method for heating compressed working fluid without having the heat pass through the walls of the container containing the compressed working fluid or the walls of the container containing the heat, comprising the steps of:

a) passing a heated fluid through the heating fluid inlet valve of a heat exchanging chamber, through a movable heat exchanger, and out through an heating fluid exit valve of said heat exchanging chamber as said movable heat exchanger moves toward and into the flow of said heated fluid, b) closing said heating fluid inlet valve of said heat exchanging chamber and said heating fluid exit valve of said heat exchanging chamber, c) introducing the compressed working fluid into said heat exchanging chamber through a compressor transfer valve while the movable heat exchanger is near one end of said heat exchanging chamber, d) closing said compressor transfer valve, e) moving said movable heat exchanger into and through said compressed working fluid so that said movable heat exchanger releases heat to, and heats up said compressed working fluid.

* * * * *